US010889991B2

(12) United States Patent
Folkersen et al.

(10) Patent No.: US 10,889,991 B2
(45) Date of Patent: Jan. 12, 2021

(54) RAKE GUTTER, GUTTER CUTTING EDGE, AND GUTTER AND SHINGLE

(71) Applicant: Roofers' Advantage Products, LLC, E. Wakefield, NH (US)

(72) Inventors: Jonny E Folkersen, E. Wakefield, NH (US); Benjamin J Folkersen, New Port Richey, FL (US)

(73) Assignee: Roofers Advantage Products, LLC, E. Wakefield, NH (US)

( * ) Notice: Subject to any disclaimer, the term of this patent is extended or adjusted under 35 U.S.C. 154(b) by 0 days.

(21) Appl. No.: 15/991,075

(22) Filed: May 29, 2018

(65) Prior Publication Data

US 2018/0347197 A1 Dec. 6, 2018

Related U.S. Application Data

(60) Provisional application No. 62/514,406, filed on Jun. 2, 2017.

(51) Int. Cl.

| | |
|---|---|
| ***E04D 13/04*** | (2006.01) |
| ***E04D 13/158*** | (2006.01) |
| ***B21D 5/16*** | (2006.01) |
| *E04D 1/34* | (2006.01) |

(52) U.S. Cl.

CPC ..... *E04D 13/0459* (2013.01); *B21D 5/16* (2013.01); *E04D 13/158* (2013.01); *E04D 13/1585* (2013.01); *E04D 2001/345* (2013.01); *E04D 2013/0468* (2013.01)

(58) Field of Classification Search

CPC ..... B21D 5/16; E04D 13/0459; E04D 13/158; E04D 2001/345; E04D 2013/0468; E04D 13/04; E04D 13/0404; E04D 13/0445; E04D 13/064

USPC ..... 52/97, 60, 94

See application file for complete search history.

(56) References Cited

U.S. PATENT DOCUMENTS

| | | | | | |
|---|---|---|---|---|---|
| 3,137,970 | A * | 6/1964 | Tiernan | E04D 13/15 | 52/630 |
| 3,188,772 | A * | 6/1965 | Tennison, Jr. | E04D 13/15 | 52/11 |
| 3,243,926 | A * | 4/1966 | Keyt | E04D 13/15 | 52/287.1 |
| 4,780,999 | A * | 11/1988 | Webb | E04D 13/155 | 52/60 |
| 5,251,411 | A * | 10/1993 | Kelley | E04D 13/064 | 156/290 |
| 6,035,587 | A * | 3/2000 | Dressler | E04D 13/0459 | 52/716.2 |
| 8,281,521 | B1 * | 10/2012 | Rasmussen | E04D 13/0459 | 52/409 |
| 8,739,470 | B1 * | 6/2014 | Wayne | E04D 13/15 | 52/58 |
| 9,200,454 | B2 * | 12/2015 | Little | E04F 13/06 | |
| 9,809,980 | B2 * | 11/2017 | Bredeweg | E04D 13/158 | |
| 10,132,085 | B2 * | 11/2018 | Bredeweg | E04D 13/158 | |
| 2003/0121217 | A1 * | 7/2003 | Grizenko | E04D 3/40 | 52/60 |

(Continued)

*Primary Examiner* — Brian E Glessner
*Assistant Examiner* — James J Buckle, Jr.
(74) *Attorney, Agent, or Firm* — Maine Cernota & Rardin

(57) ABSTRACT

A combination drip edge, rake flashing, gutter with nail flange that is useful for water harvesting and securing of shingles in adverse weather conditions.

20 Claims, 19 Drawing Sheets

(56) References Cited

U.S. PATENT DOCUMENTS

| | | | | |
|---|---|---|---|---|
| 2003/0159379 | A1* | 8/2003 | Pickler | E04D 13/0459 52/283 |
| 2005/0005551 | A1* | 1/2005 | Graham | E04D 13/0459 52/415 |
| 2006/0016130 | A1* | 1/2006 | Lin | E04D 13/15 52/24 |
| 2017/0145697 | A1* | 5/2017 | Anthony | E04D 13/0727 |
| 2017/0226741 | A1* | 8/2017 | Givens | E04D 13/15 |
| 2018/0209152 | A1* | 7/2018 | Heo | E04D 13/0459 |
| 2018/0209153 | A1* | 7/2018 | Heo | E04D 13/155 |
| 2019/0071873 | A1* | 3/2019 | Dye | E04D 13/0459 |

* cited by examiner

RAKE GUTTER, GUTTER CUTTING EDGE, AND GUTTER AND SHINGLE

RELATED APPLICATIONS

This application claims the benefit of U.S. Provisional Application No. 62/514,406, filed Jun. 2, 2017. This application is herein incorporated by reference in its entirety for all purposes.

FIELD OF THE INVENTION

The invention relates to a roofing drip edge, and more particularly, to a rake drip edge, which acts like a rake edge gutter and provides for a shingle cutting guide and a shingle locking mechanism.

BACKGROUND OF THE INVENTION

The vast majority of sloped roofing systems installed in North America are asphalt shingle systems. Such installations generally require the installation of drip edges, which help to seal the building against water intrusion, adjacent edges of the building envelope. After installing one of these drip edges at the rake and eave, a starter shingle is typically installed on top of a drip edge. Then field shingles are installed onto the starter shingles using fasteners, with the possible combination of plastic roof cement at the interface of the starter shingle and drip edge nailing flange. Approximately 90% of field shingles used at rake locations will require cutting to a requisite length, in order to maintain manufacturer field shingle side lap requirements thereby providing for a warranty worthy roof.

The majority of the field shingles installed today are a laminate, dimensional or as commonly known "architectural" shingles, resulting in variable thicknesses requiring trimming to length at the rake location. A laminate shingle is difficult to trim in a straight line when cold, even when trying to follow a starter shingle or when using a line placed onto the surface of the field shingle. Field shingles which have been installed past the starter shingle outer edge will not be visible from the roof top or gable by the roofer performing the work. As the roofer cuts these shingles from the roof top an irregular looking rake edge is often the outcome which further drives moisture off the gable end of the structure.

As such, when commencing an asphalt shingle roof from the rake edge, as shown in FIG. 1, field shingles 2001 are cut to a specific length, which, when installed, create a ladder effect 2002. This eliminates a seam over seam installation throughout the completed system. These field shingles 2001 are called books of shingles and once installed field shingles 2001 can complete the installation to the opposite rake edge 2003. At the rake edge(s) approximately 90% of field shingles 2001 will need to be cut to a specific length on site. This is typically accomplished by measuring the required shingle length and cutting the field shingle 2001 on the ground or on the roof. Often the field shingle 2001 is cut to length after being installed and even more so when reaching the opposite rake 2003 edge. This is accomplished by running the field shingle 2001 past the starter shingle 2004 on the rake edge 2003. Then chalking a visible mark onto the exposed surface of the field shingle at the rake termination point and using a hook blade 2005 to make the final cut.

The installation of a metal drip edge at the rake location has become code mandated, as well as a best practice, in sloped asphalt roofing applications. The rake drip edge is typically placed onto and over an underlayment and secured using fasteners driven through a nailing flange of the drip edge and into the substrate. Typically, both the rake and eave drip edge are of the same profile. An example of this profile can be found in Rasmussen, US20120233933A1. The industry term for this general profile is a "D-style" drip edge.

In addition to the "D-style" drip edge, many other profiles are available. While the profiles vary from region to region, the vast majority share common elements, including rake trim overhang and a nail flange that is used for drip edge securement to the building.

These drip edges, when installed at rake locations, have a number of limitations, including an inability to harvest water off the rake edge. These drip edges also require additional products to complete construction, frequently expose the shingle edge to weather, and are prone to water infiltration at the interface between the shingle and the drip edge nail flange.

Other notable attempts to seal a structure include a one-piece roof-material-protecting drip edge, as disclosed by Wayne in U.S. Pat. No. 8,739,470B1. This profile may protect the rake leading edge of the finished roofing material from wind uplift, but the asphalt shingle has to be cut to size prior to installation to fit within the space created between the parallel top and base panels. Furthermore, the implementation of the teachings of this disclosure would result in moisture being driven into the interface between the nail flange and the shingle, creating both short and long term issues.

More specifically, the invention of Wayne is prone to trapping snow and ice at the interface of panel 26 and exposed panel 18. A substantial amount of water is not redirected over the top surface panel 16 and ends up at the bottom of the outer surface transition 20. The holes 36 may not be called out for a rake edge device, but, during heavy rain events, water becomes trapped and is redirected to the interface of folded lip 30 and base 12, ending up at the bottom of outer surface transition 20.

In addition to these issues, this transition and related fold is prone to sedimentary buildup ice expansion over time. A single impediment or the cycles of freeze and thaw causes the gap between the interface of panel 26 and the exposed panel 18 to grow. This increased gapping, along with the initial creation of a pivot point at the outer surface transition 20, makes the device prone to across-the-roof-plane failure, due to pivot point metal fatigue, which may be exacerbated by a sudden high wind event directed across the roof plane.

Wayne further discloses a water curl 14 "which is included to divert water straight down as needed". When relying on a water curl 14, shingles settle into the base 12, making the performance requirements of the water curl 14 moot. The limited amount of water which may make its way to the water curl 14 means water is being pushed into the interface of the base 12 and the shingles 22.

What is needed, therefore, is a rake edge gutter that eliminates products and steps, such as the use of a guide to mark shingles and subsequently cut them to length, currently required at a rake edge when applying an asphalt shingle system to a roof, while solving various issues with prior art products and techniques, those issues including dealing with moisture coming off the gable end of structures, protecting shingles from wind uplift, and hiding shingle edges, which may be irregular, without preventing shingle expansion and contraction, which could result in long-term damage to the shingle.

SUMMARY OF THE INVENTION

This disclosure deals with roofing, and more specifically with metal edging that is installed up the edge of the sloped part of an asphalt shingled roof, which is commonly referred to as the rake edge. More specifically, a nailing flange with a rake edge gutter and elevated exterior plane, which terminates into an asphalt shingle cutting guide, with the inside hem of the cutting guide becoming useful for shingle securement with variations of the same, is herein disclosed.

The rapid increase in the use of "architectural" shingles has had an unforeseen consequence. A typical looking laminate shingle can be found in Belt U.S. Pat. No. 7,836,654B2, FIG. 1. The underlayment sheet 66 is partially caped with an overlay sheet 68. The unforeseen consequence is movement of water towards the butt end of the shingle 74A and 74B. The angled nature of the overlay sheet drives moisture towards the rake edge. Regardless of where the field shingle is cut to length, when trimmed at an underlay area, the water will be routed towards the rake edge.

It is human nature to cut an "architectural" shingle at the point of least resistance. For this reason, the roof mechanic, if presented with the option, will cut the field shingle where the underlay area runs through the entire field shingle with the unforeseen consequence of additional water moving towards the rake edge. Embodiments of the present disclosure capture, funnel, and deliver this moisture away from the building envelope.

A cutting guide in accordance with embodiments of the present disclosure also allows a hooked blade or other cutting device to be used in an abutment area or groove of the rake edge gutter, even when hidden under field shingles extending onto and over the cutting guide.

If such a cutting guide or elevated exterior plane was installed on eave-mounted gutters, where the outside gutter edge protrudes above the roof plane, sliding ice and snow could damage and even dislodge an eave gutter. Although Sliding ice and snow is most common with metal roof applications it can also occur with asphalt shingle installations. In embodiments, therefore the rake edge gutter is positioned above the roof plane. The elevated exterior plane of the gutter, in relation to the roof plane, redirects water back into the rake edge gutter that flows off of the gable end of buildings during rain events, especially when combined with wind.

Embodiments of the rake edge gutter disclosed herein further permit running a shingle past the rake edge and using a feature on the gutter as a cutting guide for trimming field shingles. The field shingle is trimmed using the feature on the rake edge gutter as a cutting guide into which a hook blade or other cutting device can abut or be inserted. In embodiments, after cutting the field shingle to length, the shingle drops down to the downward angled or downward hooked roof securement extension, permitting the shingle to be pushed into place.

This downward angled securement extension puts less pressure on the rake edge from weather forces traveling across the roof plane by catching less wind, while the downward angled hem, in conjunction with the elevated exterior plane and cutting edge of embodiments, diverts water back towards the rake gutter area. Furthermore, weather forces directed towards the gable end of a roof tend to push the downward angled hem into the field shingle, resulting in additional field shingle securement during high wind events. While on site, should a ladder need to be placed up against the gable of embodiments of the gutter disclosed herein, the downward angled hem imbeds itself further into the field shingle while providing for less movement of the drip edge and the ladder, increasing safety.

One embodiment of the present invention provides a drip edge, the drip edge comprising: flashing configured in the form of a drip edge and having an upper face designed to be upwards-facing upon installation onto a roof, the flashing further comprising a nail flange configured to indicate to an installer the appropriate location(s) in which to nail the drip edge to a roof and a cutting guide configured to allow an installer to run a hook blade along to cut roofing shingles to an appropriate length, wherein the flashing is configured to be installed parallel and adjacent to a rake edge; and a gutter fixed to an edge of the flashing, wherein the gutter is configured to extend below the rake edge of a roof when the flashing is fixed to a portion of roof substrate adjacent the rake edge.

Another embodiment of the present disclosure provides such a drip edge wherein the gutter and flashing are a single, unitary piece of sheet metal.

A further embodiment of the present disclosure provides such a drip edge wherein the gutter further comprises a shingle-securing section, wherein the shingle-securing section is configured to help secure the shingle to the roof on which the drip edge is installed.

Yet another embodiment of the present disclosure provides such a drip edge wherein the shingle-securing section comprises a top portion of the gutter configured to be folded over onto the shingle, following the installation thereof, thereby securing the shingle against wind uplift while simultaneously hiding the cut edge thereof.

A yet further embodiment of the present disclosure provides such a drip edge wherein an interface between the gutter and the shingle securing section thereof is pre-weakened, thereby allowing the section to be more easily bent over a shingle.

Still another embodiment of the present disclosure provides such a drip edge wherein a flashing-facing portion of the gutter is oriented perpendicularly to the upper face of the flashing and further comprises a downward-facing protrusion configured to cover a shingle abutting the flashing-facing portion of the gutter.

A still further embodiment of the present disclosure provides such a drip edge further comprising an upward-facing protrusion that is also angled towards the flashing portion of the drip edge, wherein the upward-facing protrusion is configured to add rigidity to the drip edge while forcing the downward-facing protrusion configured to cover a shingle abutting the flashing-facing portion of the gutter into forceful contact with a shingle positioned between the upper face of the flashing and the downward-facing protrusion during across-the-roof wind events wherein the wind is incident on an outside edge of the drip edge.

Even another embodiment of the present disclosure provides such a drip edge wherein an uppermost-portion of the flashing-facing portion of the gutter comprises a double hem.

An even further embodiment of the present disclosure provides such a drip edge wherein the nail flange comprises a plurality of apertures sized to accept nails therethrough and to mark desired nailing locations.

A still even another embodiment of the present disclosure provides such a drip edge wherein the apertures are oval in shape.

A still even further embodiment of the present disclosure provides such a drip edge wherein the apertures are square in shape.

A still even further embodiment of the present disclosure provides such a drip edge wherein the apertures are circular in shape.

Still yet another embodiment of the present disclosure provides such a drip edge wherein the apertures are rectangular in shape.

A still yet further embodiment of the present disclosure provides such a drip edge wherein the flashing, on a lowest point of an outward-facing face thereof, further comprises a kick configured to be angled outwardly from a roof following installation of the drip edge thereon.

Even yet another embodiment of the present disclosure provides such a drip edge wherein the upper face of the flashing further comprises markings describing the desired location of field shingle termination points thereon.

An even yet further embodiment of the present disclosure provides such a drip edge wherein the drip edge is configured to deliver moisture into a fascia mounted gutter without the use of downpipes.

Still even yet another embodiment of the present disclosure provides such a drip edge wherein an outer edge of the gutter is elevated above the upper face of the flashing.

A still even yet further embodiment of the present disclosure provides such a drip edge wherein the drip edge is made of a material selected from the group consisting of flat sheet coil metal, flat sheet metal, and plastic.

One embodiment of the present disclosure provides a rake edge gutter, the rake edge gutter comprising: an upper section, a lower section opposite the upper section, an outer section and an inner section opposite the outer section, wherein the inner section is configured to be positioned behind, and terminate below, a rake edge, abutting against a building envelope, following installation of the rake edge gutter on a rake edge, wherein the outer section is substantially taller than the inner section and is configured to extend above a rake edge following installation of the rake edge gutter on a rake edge, wherein the lower section connects the inner section to the outer section and is configured to extend past a rake edge following installation of the rake edge gutter on a rake edge, wherein the upper section further comprises a proximal portion fixed to the outer section and a distal end positioned closest to the inner section of the rake edge gutter, and wherein the distal portion of the upper section further comprises a protrusion angled towards the inner section, the protrusion configured to hide the cut edge of a shingle, act as a barrier against cross-winds that could cause shingle uplift, and capture moisture blown across the field of a roof and direct it into the gutter formed by the C-shaped channel formed by the inner, outer, and lower sections of the rake edge gutter.

Another embodiment of the present disclosure provides such a rake edge of claim 19 wherein the gutter is predrilled for fasteners.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
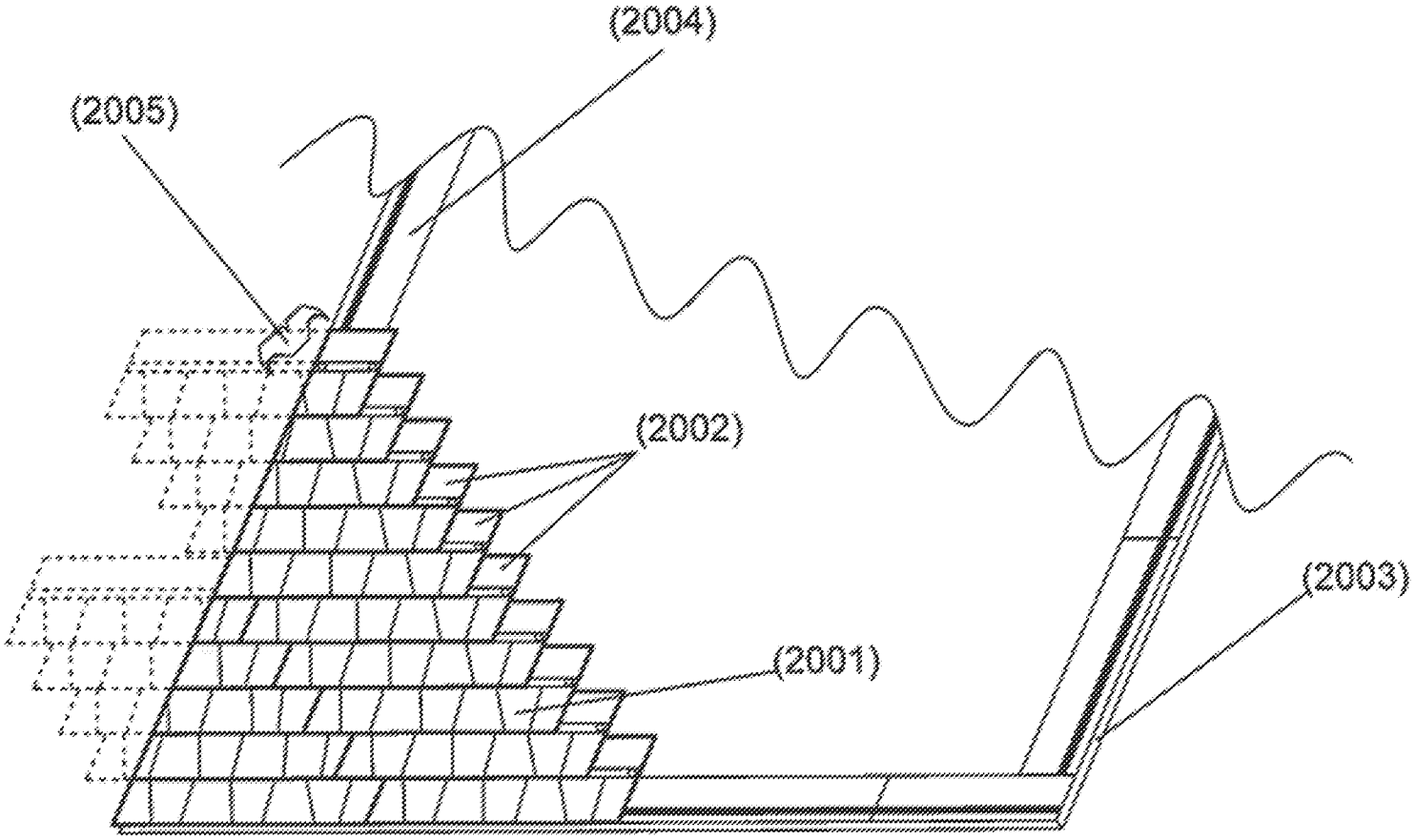
FIG. 1 is a front, upper perspective view of a roof showing the installation of field shingles, in accordance with embodiments of the present disclosure.

Embodiments of the present disclosure comprise a rake edge gutter that eliminates products and steps, including the use of a guide to mark shingles and subsequently cut them to length, currently required at a rake edge when applying an asphalt shingle system to a roof, while solving various issues with prior art products and techniques, those issues including dealing with moisture coming off the gable end of structures, protecting shingles from wind uplift, and hiding shingle edges, which may be irregular, without preventing shingle expansion and contraction, which could result in long-term damage to the shingle.

In addition, embodiments provide a cutting guide, which, during high wind events, provides for additional height above the roof plane and directs water back into the rake gutter. This feature helps ensure that areas around windows and doors remains leak free while generally improving the long term performance of gable end finishes, such as, paints, trims and siding, all of which can be damaged by repeated water running down the gable end of the structure. Furthermore, embodiments are configured to redirect water into existing eave installed gutters, permitting for water mitigation and harvesting, in embodiments using fascia-installed gutter systems, which are readily available.

Notably, roofers typically use identical rake edge profiles (D-style or L-Style, or other) on both rakes and eaves. Where the rake and the fascia meet, a fold, trimming, or mitering is required for a clean, seamless look.

In embodiments, installation of a drip edge in accordance with embodiments begins with the installation of a standard drip edge along an eave of a structure to be roofed, making sure that the end of the eave metal is flush with the outside edge of the rake trim. At this point, the end of the eave drip edge, including the nose, nose underside, face, and drip kick are exposed to the rake edge; these facets are eventually capped using the inside edge of our gutter. The depth of the rake gutter can be fabricated to match the distance between the nose and the end of the drip edge kick, on a standard eave mounted drip edge. As such, folding, trimming or mitering of drip edges at the rake/eave interface, in such embodiments, is eliminated.

In embodiments, when installing the rake edge gutter, the nailing flange is terminated approximately ⅜" past the nose of the eave drip edge. This caps the end of the eave drip edge and provides a starting point for starter and field shingle overhang at the eave location. The nail flange overhang (the distance between the nose of the underlying eave drip edge and the end of the rake edge gutter nailing flange) can also be utilized as the overhang requirement of the shingles along the eave location.

In addition to delivering water away from the fascia, the shingles are now reinforced with the rake edge nail flange at the critical eave/rake intersection point by the rake edge gutter nailing flange overhang. During high wind events the shingles positioned at fascia to rake edge overhang points are less prone to failure, due to being supported on the underside by metal from the rake edge gutter nail flange ⅜" overhang.

Figure 2:
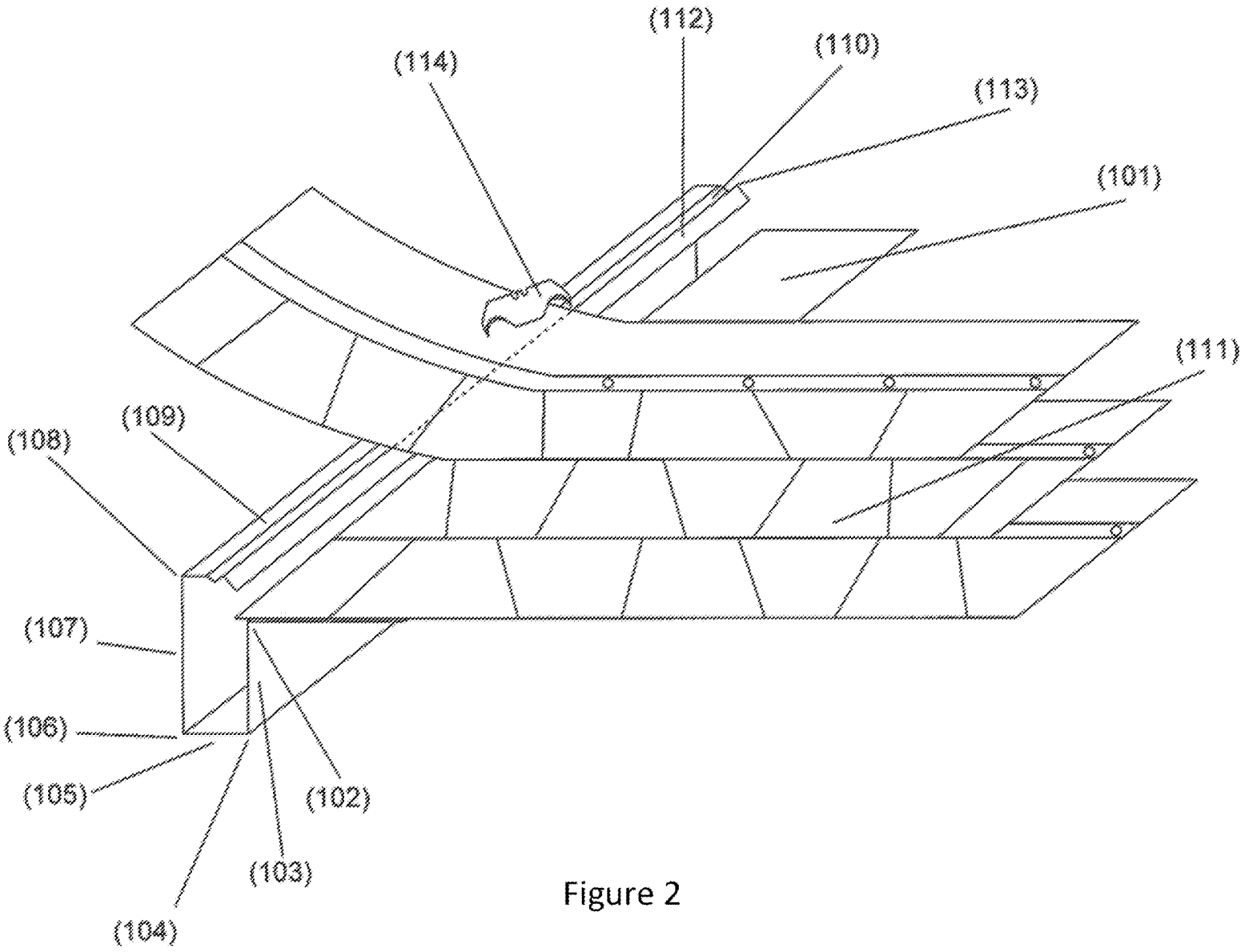
FIG. 2 is a front, upper, left side perspective view of a drip edge gutter, configured in accordance with embodiments of the present disclosure.

In such embodiments of our rake edge gutter, as illustrated by FIG. 2, the nail flange 101 is bent at approximately 90 degrees 102, creating an inside gutter edge 103, which ends up abutting and parallel to the rake edge trim. This inside gutter edge 103 is then further bent at approximately 90 degrees 104, creating a rake edge gutter bottom 105 and may be further bent at approximately 90 degrees 106, creating an outside elevated exterior plane 107 of the rake edge gutter. The elevated exterior plane 107, in embodiments, is further bent at approximately 90 degrees 108 and parallel to the nail flange 101, forming a top edge 109. The top edge 109, in embodiments, has a grove or elevated nodule 110, which is used as a shingle 111 cutting guide. The groove or elevated nodule 110, in embodiments, terminates into a downward angled extension 112, which is bent at approximately 45 degrees 113, permitting the shingle 11 to be pushed into the rake edge gutter area and secured from wind uplift. As such, running the shingle 111 past, over and onto the elevated exterior plane 107 provides for after-installation trimming of shingles 111 using a hook blade 114 or similar device, saving the roofer time and eliminating additional steps and materials now required at rake locations.

Figure 3:
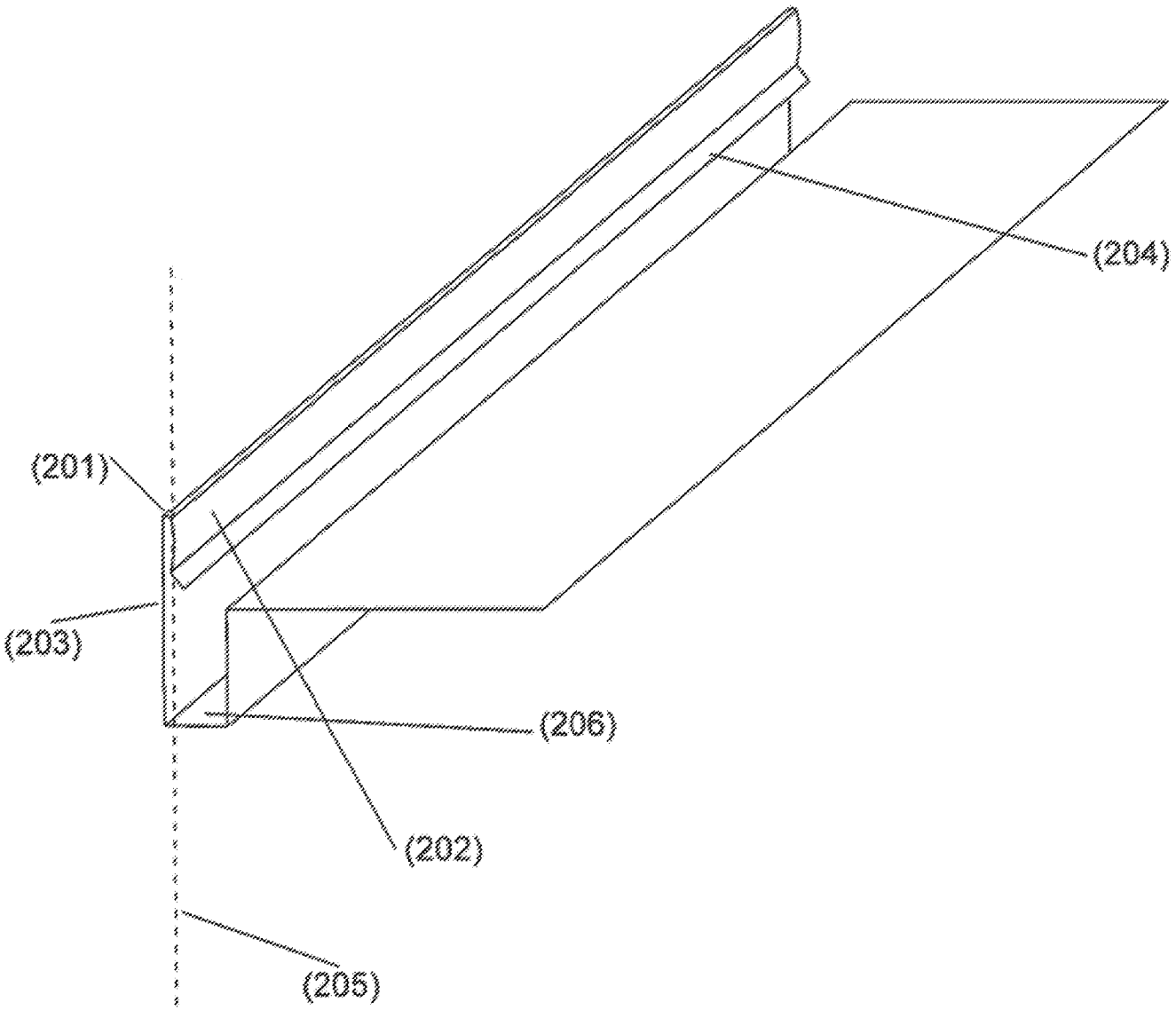
FIG. 3 is a front, upper, left side perspective view of a drip edge gutter, configured in accordance with embodiments of the present disclosure.

In embodiments, the rake edge gutter disclosed herein, as shown in FIG. 3, is created from a single piece of metal with a slightly looped 202 hem at the cutting guide 202. The cutting guide 201, in embodiments, is not a truly closed hem and may be slightly looped 202, thereby providing for additional gapping of a shingle relative to the exterior elevated plane 203, once installed. This slightly looped 202 hem makes it easier when one elevated exterior plane 203 of one section becomes inserted into another section during construction. The exterior elevated plane 203, which becomes the cutting guide 202 and is slightly looped 202, in embodiments, thereby creating a gap, as depicted by the distance between imaginary line 205 and an inside edge of the elevated exterior plane 203. This gap permits for shingle expansion and contraction over time. In addition, some shingle material is removed when cutting the field shingle, which further increases the gap.

Once the shingle is cut to length, in embodiments, it is manually pushed onto the angled securement 204 area, which, in embodiments, is fabricated in such a fashion as to not require additional shingle trimming to become lodged under the angled securement 204 area. This gap provides for shingle movement, which is often due to changes in temperature or building movement, thereby preventing shingle cupping at the rake edge. The gap created between the end of the field shingle and the inside of the exterior elevated plane 203 also permits water egress into the rake edge gutter 206.

Figure 4:
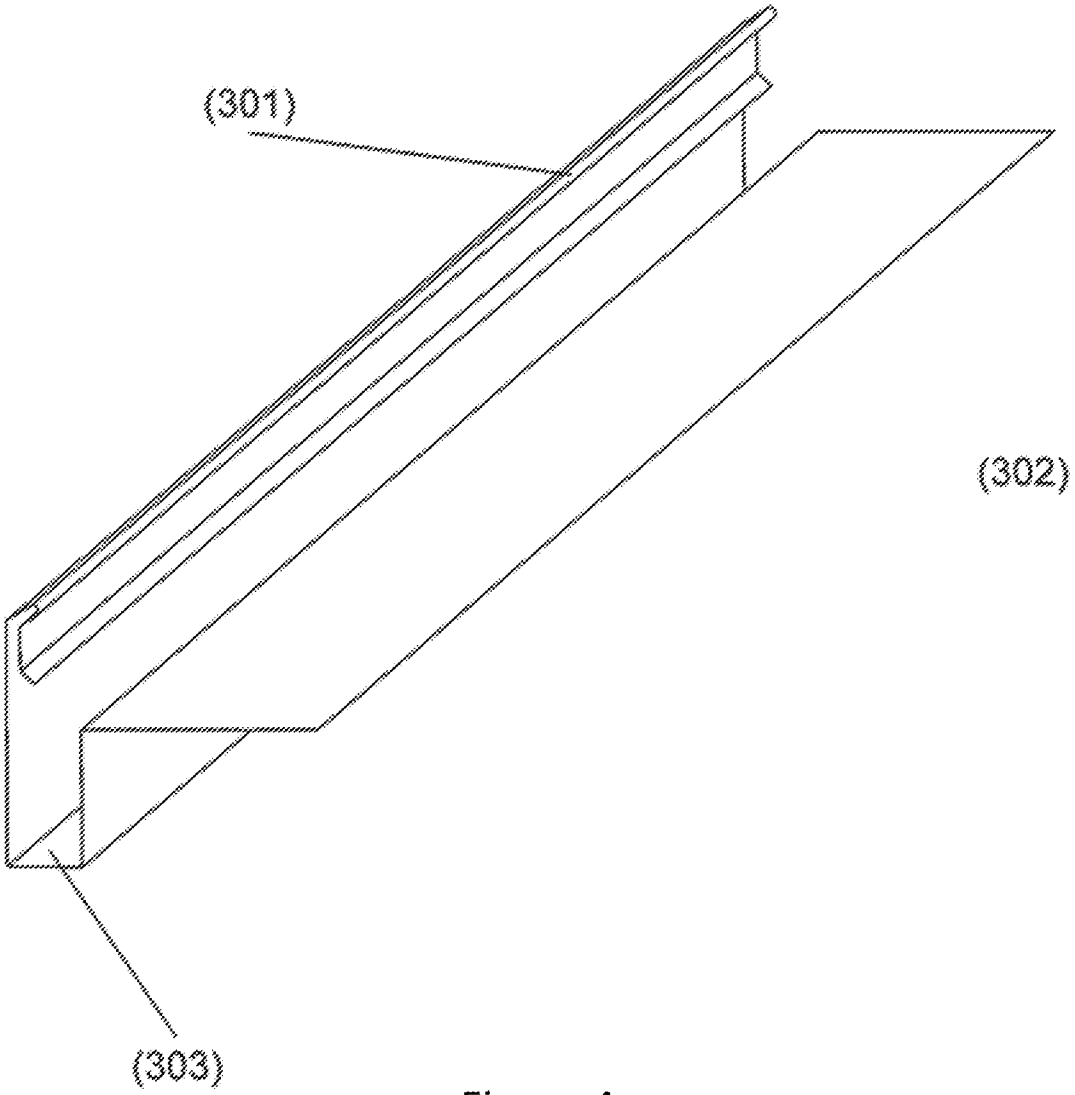
FIG. 4 is a front, upper, left side perspective view of a drip edge gutter, configured in accordance with embodiments of the present disclosure.

In embodiments of the rake edge gutter disclosed herein, such as that shown in FIG. 4, the cutting guide 301 may be pivoted towards the field of the roof 302 to provide additional field shingle gapping, if required or found desirable. This feature also further redirects water back into the rake gutter 303 during across-the-field-of-roof 302 rain events.

Figure 5A:
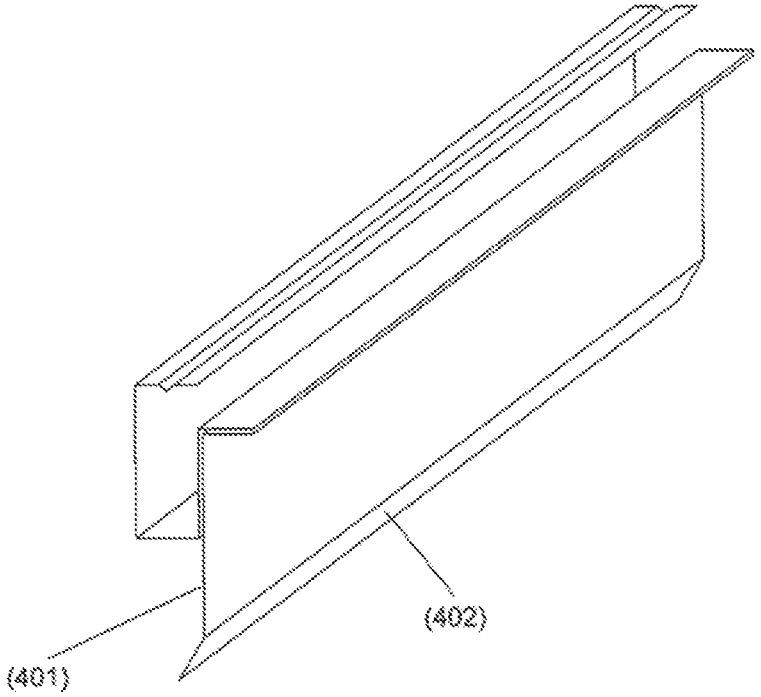
FIG. 5A is a back, upper, right side perspective view of a drip edge configured in accordance with embodiments of the present disclosure.
Figure 5B:
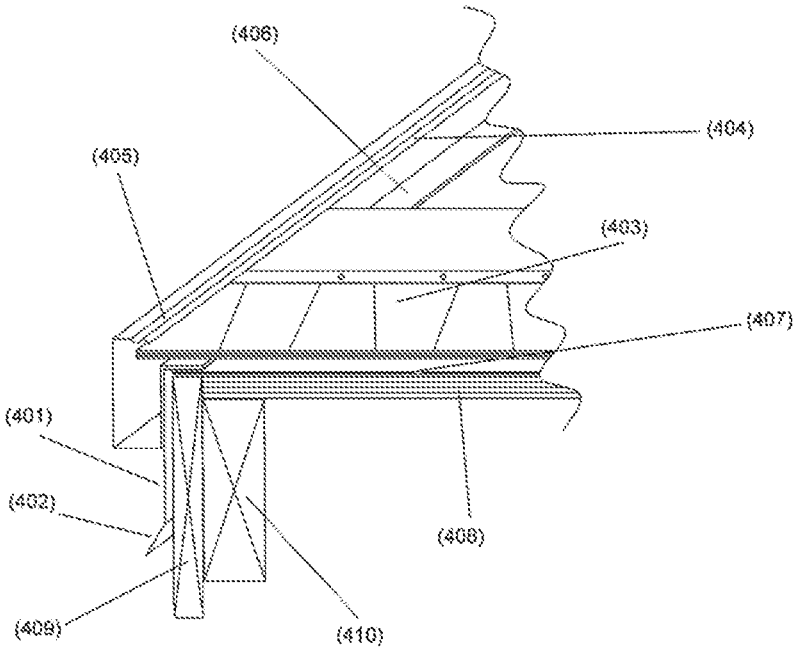
FIG. 5B is an illustration of a roof showing the drip edge of FIG. 5A installed thereon.

In further rake edge gutter embodiments, such as that shown in FIG. 5A, a leg 401 with a kick 402 is added to any rake edge gutter, easily matching an eave "L-style" drip edge or to meet code requirements for gable end protection. A cross section of the rake edge gutter is shown in FIG. 5B, installed onto a rake edge, with shingles 403 and a leg 401, which may be done with or without a kick 402 being added to the rake edge gutter.

In this installed cross section, the roofing shingles 403 are locked under the downward securement extension 404 and have already been cut to length, in this case, using a cutting groove 405. In embodiments, the rake edge gutter nail flange 406 is placed on top of the underlayment 407 and the nail flange 406 is fastened through the underlayment 407, into a substrate 408, rake trim 409, and in embodiments, into a framing member 210.

Figure 6:
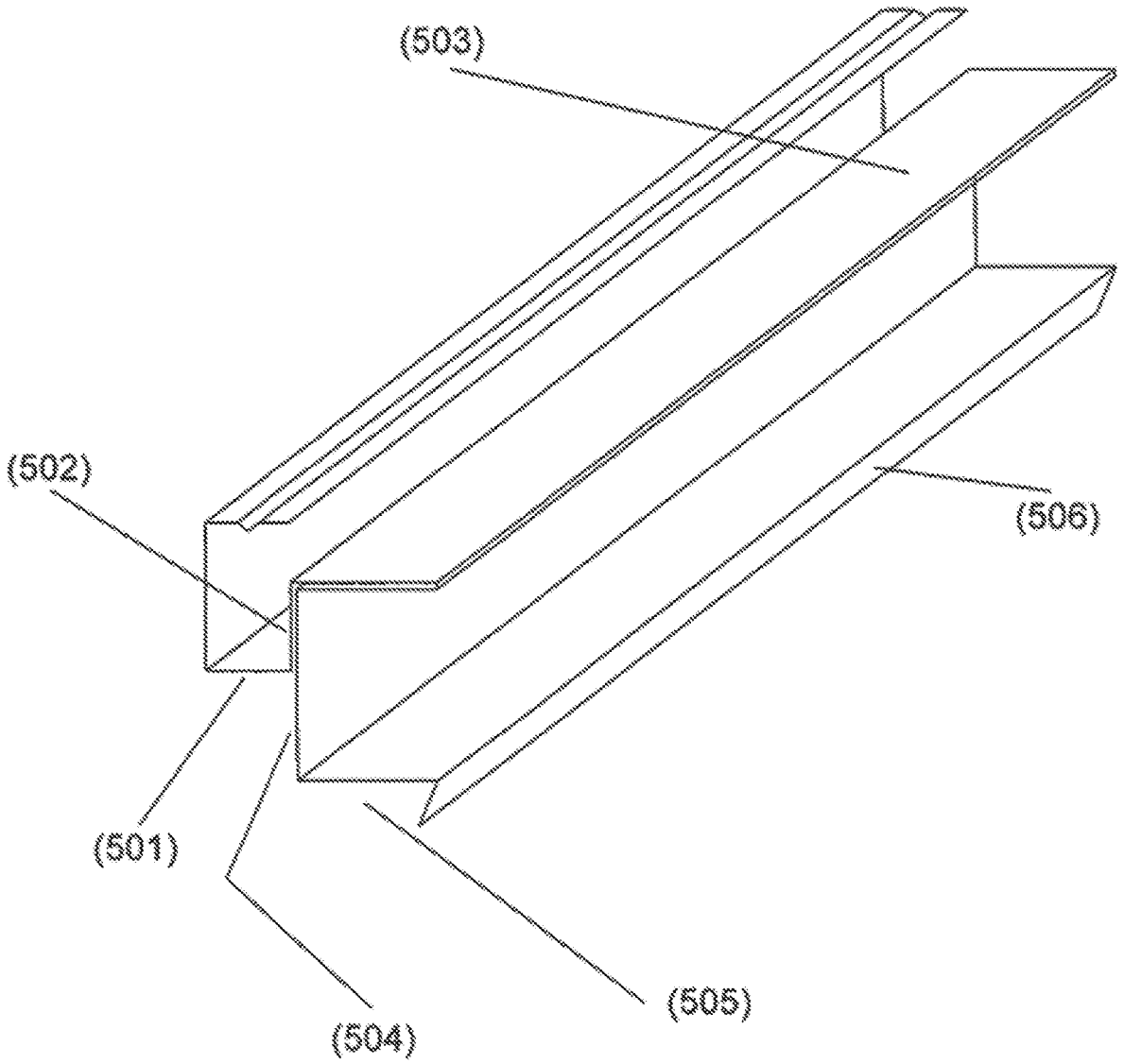
FIG. 6 is a back, upper, right side perspective view of a drip edge configured in accordance with embodiments of the present disclosure.

In the embodiment depicted in FIG. 6, a second layer shingle system is illustrated. When placing a second layer onto an existing roof, a thick, unsightly rake edge of shingles that is prone to wind driven failure can result, often ultimately resulting in moisture infiltrating the layers. To combat this issue, some roofing companies have begun installing a "C-style" drip edge, which is placed over and may cap the existing drip edge, providing for a single layer appearance. In embodiments of the present disclosure, a rake edge gutter 501 rear flange 502 becomes the nail flange 503, returning onto itself with outer plane 504 and abutting a rear flange 502 of the gutter 501. In embodiments, the outer plane 504 is bent at approximately 90 degrees into a lower flange 505, which terminates in a kick 506. This embodiment provides for a rake edge gutter benefit for second layer roof applications.

Figure 7A:
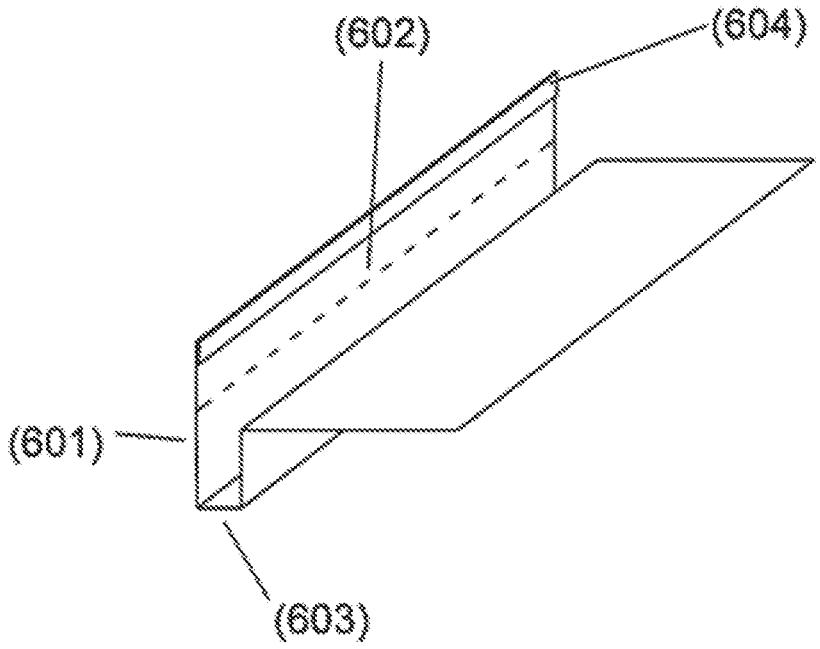
FIG. 7A is a back, upper, right side perspective view of a drip edge configured in accordance with embodiments of the present disclosure.
Figure 7B:
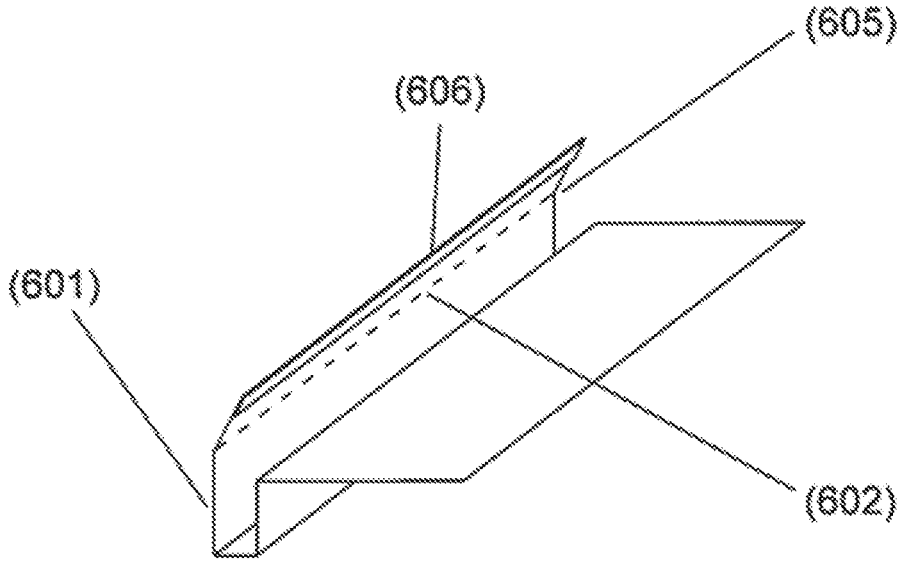
FIG. 7B is a back, upper, right side perspective view of the drip edge of FIG. 7A with a top portion bent inwards, configured in accordance with embodiments of the present disclosure.
Figure 7C:
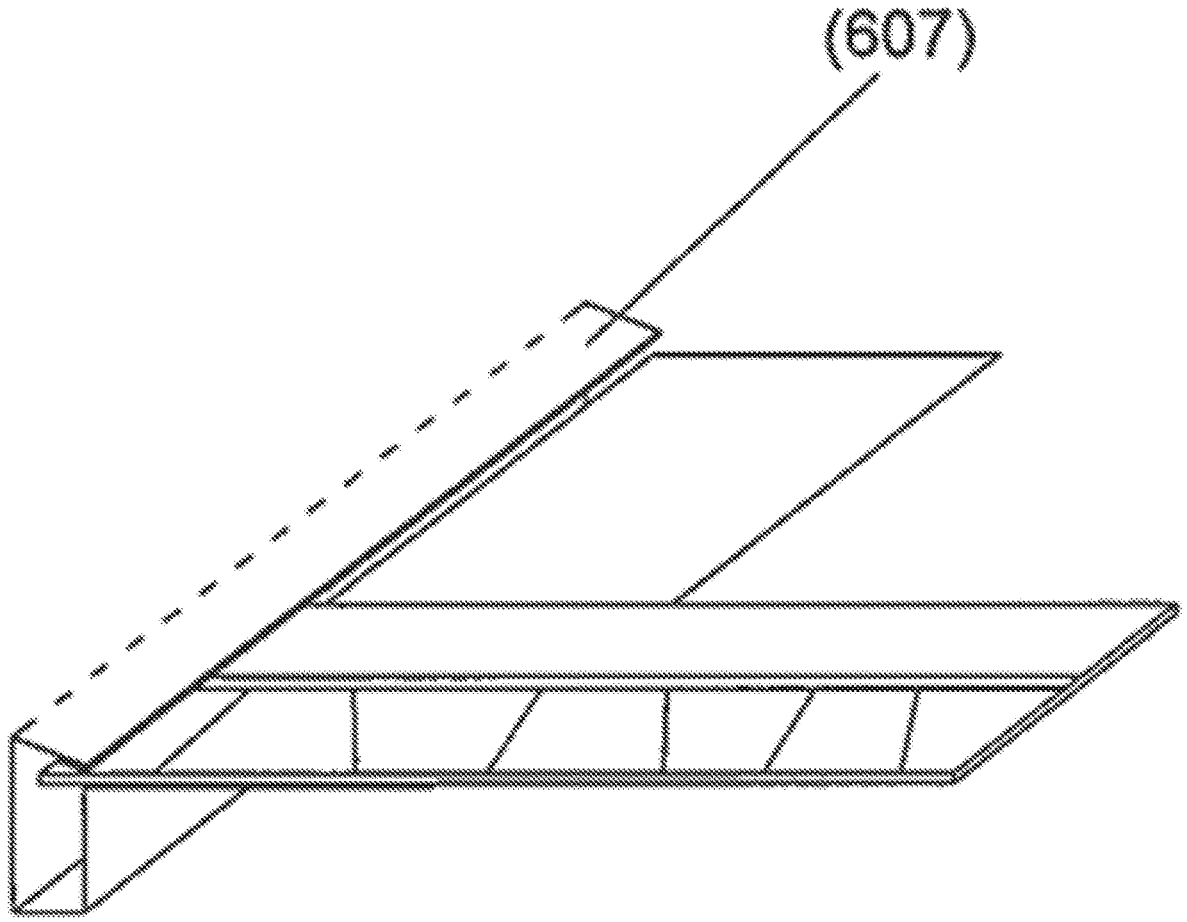
FIG. 7C is a back, upper, right side perspective view of the drip edge of FIGS. 7A and 7B showing a shingle mounted therein, configured in accordance with embodiments of the present disclosure.

In embodiments, such as that shown in FIG. 7A, the elevated exterior plane 601 is structurally weakened 602 above the rake edge gutter 603 and may be bent over after installation. The exterior plane 601 may be structurally weakened 602 at a specific location, thereby easing the creation of the downward angled securement extension 604. The elevated exterior plane 601 (see FIG. 7B), in embodiments, is slightly angled 605 towards the roof along the structurally weakened 602 area and can still be used as a cutting guide 606 while becoming the actual downward angled securement extension 607. This structurally weakened 602 and slightly angled 605 exterior plane 601 (see FIG. 7C) further assists the roofer when completing the downward angled shingle securement extension 607.

In embodiments, a specific metal forming tool may be created for this embodiment. For example, the underside of the gutter may be used for the leverage needed to bend the roof securement extension 607 onto the asphalt or metal roof. The structurally weakened 602 location becomes the point at which the metal can be bent towards the roof. This tool can be made available to installers which factors for the height from the bottom of the gutter 603 relative to the top of the cutting guide 606, thereby using the cutting guide 606 as leverage to complete the detail. The added benefit of this design and method is that the downward angled securement extension 607 may be brought very tight to the finished roof.

Figure 8A:
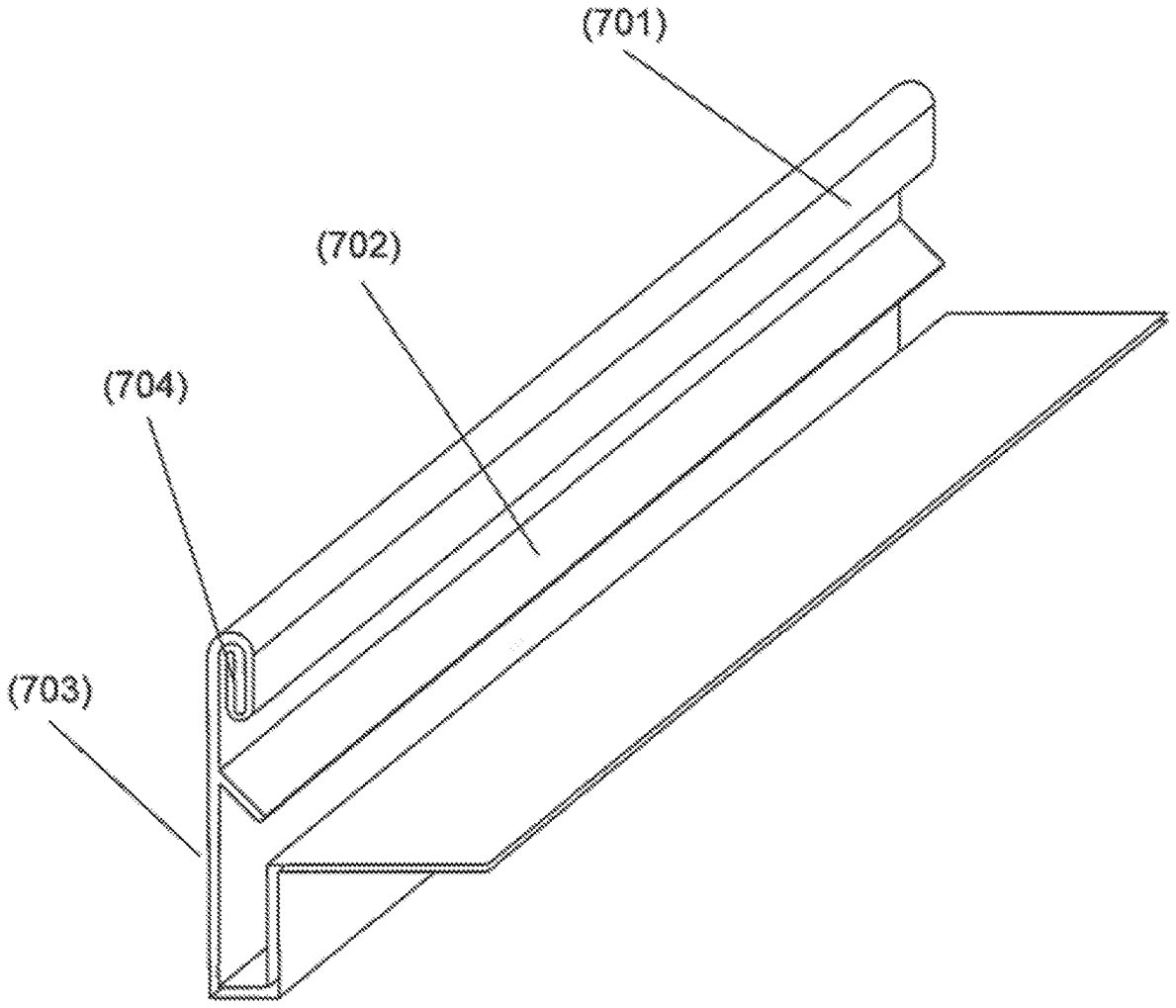
FIG. 8A is a front, upper, left side perspective view of a drip edge gutter with a double closed hem, configured in accordance with embodiments of the present disclosure.

In embodiments, such as that shown in FIG. 8A, the entire rake edge gutter is manufactured using a material that is folded onto itself. This type of fabrication permits for additional options, such as a double closed hem 704 at the cutting guide 701, thereby maintaining the shingle gapping benefits discussed earlier. This also permits for the angled securement extension 702 to remain hidden by the elevated exterior plane 703.

Figure 8B:
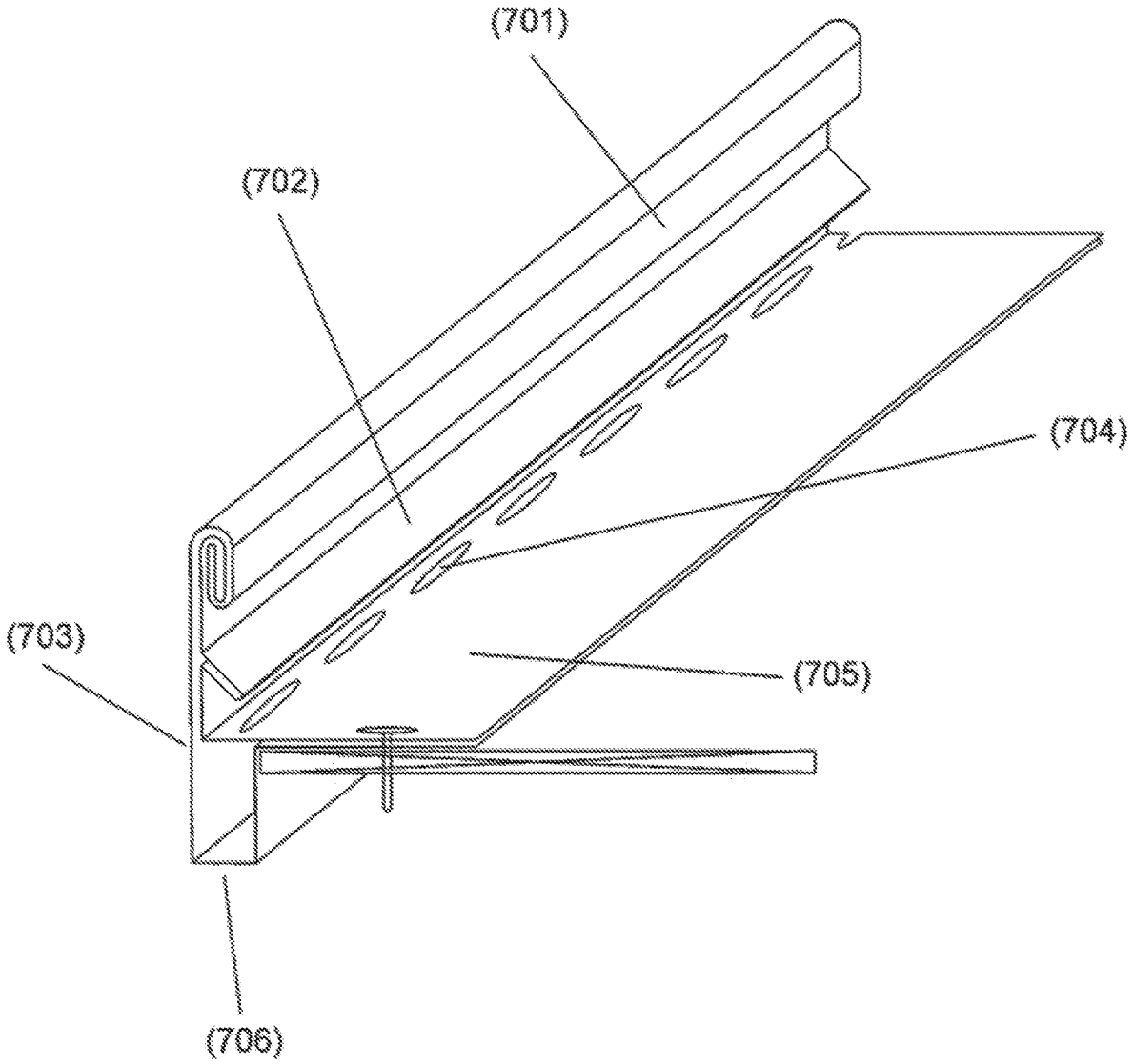
FIG. 8B is a front, upper, left side perspective view of the drip edge gutter of FIG. 8A showing a nail nailed through oval-shaped openings in the nail flange thereof, configured in accordance with embodiments of the present disclosure.
Figure 8C:
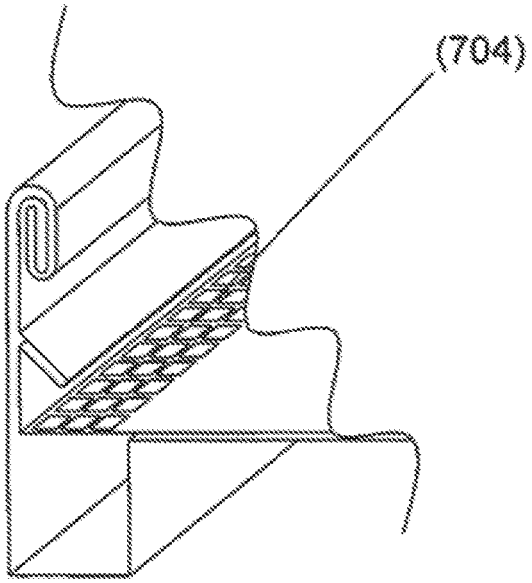
FIG. 8C is a front, upper, left side perspective view of the drip edge gutter of FIG. 8A having square nail flange openings, in accordance with embodiments of the present disclosure.
Figure 8D:
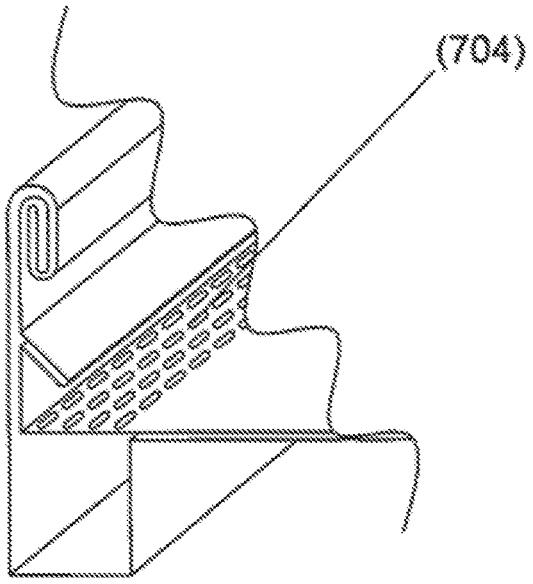
FIG. 8D is a front, upper, left side perspective view of the drip edge gutter of FIG. 8A having small, oval nail flange openings, in accordance with embodiments of the present disclosure.
Figure 8E:
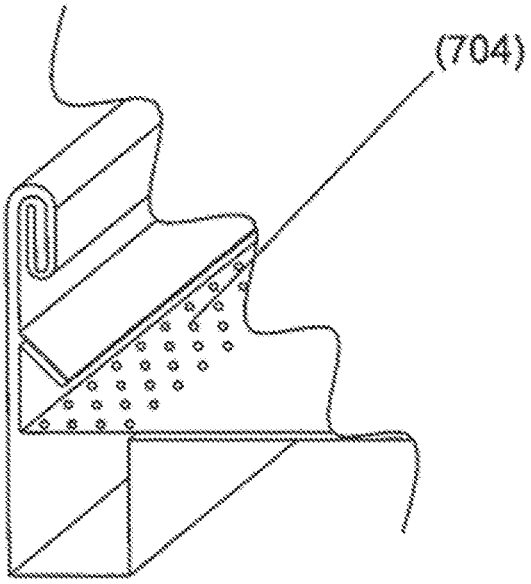
FIG. 8E is a front, upper, left side perspective view of the drip edge gutter of FIG. 8A having circular nail flange openings, in accordance with embodiments of the present disclosure.
Figure 8F:
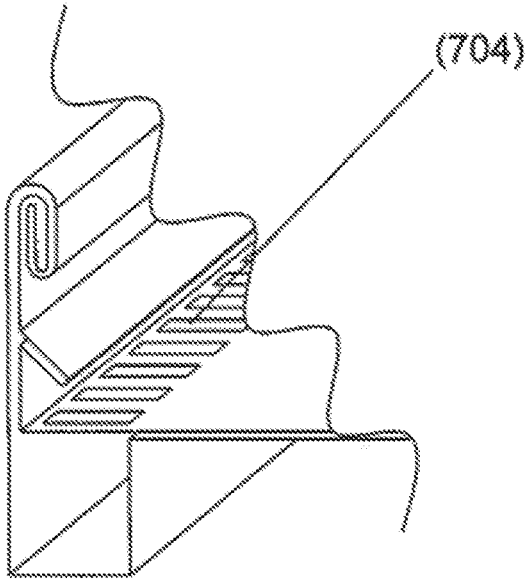
FIG. 8F is a front, upper, left side perspective view of the drip edge gutter of FIG. 8A having rectangular nail flange openings, in accordance with embodiments of the present disclosure.

In addition, as shown in FIG. 8B, this type of fold approach requires incremental openings 704 in the flat plane of the nail flange 705 that overhangs the rake edge gutter 706. The openings 704 permit for water egress into the rake edge gutter 706. This device provides for an additional nailing flange 705 that further supports the gutter 706 by providing rigidity when the nail flange 705 is fastened directly to the roof deck, prior to installing shingles. Numerous opening 704 styles are disclosed in FIGS. 8C-8F while additional variations would be known to those of ordinary skill in the art.

Figure 9A:
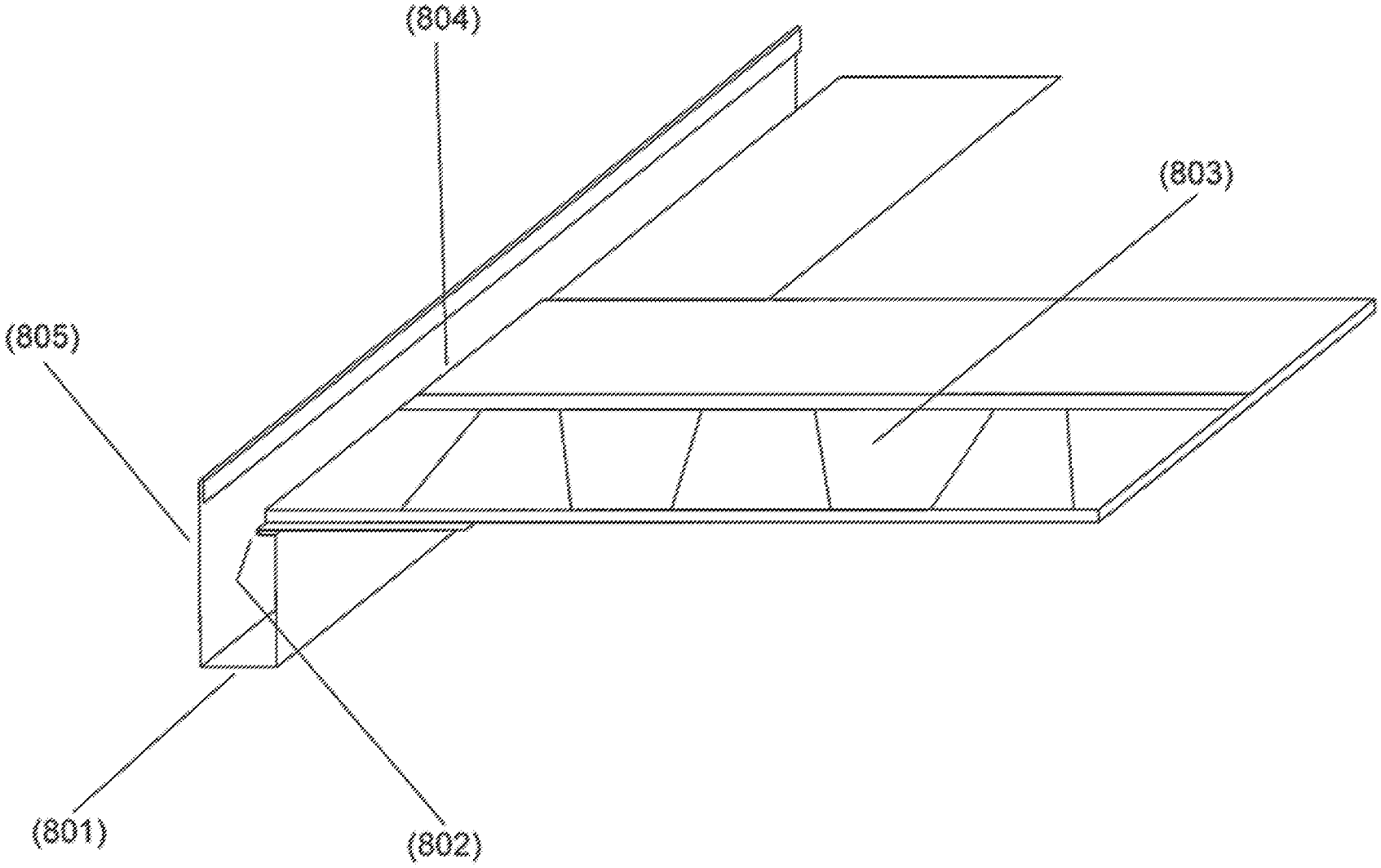
FIG. 9A is a front, upper, left side perspective view of a gutter with cutting guide and shingle mounted thereon, in accordance with embodiments of the present disclosure.

FIG. 9A provides yet another example of a rake edge gutter. This embodiment leaves the rake edge gutter 801 exposed after installation. In embodiments, this is accomplished using a material which is folded onto itself, as described in FIG. 8A, or from a single piece of relatively heavy gauge metal. In such embodiments, the inside horizontal gutter cutting guide 802 is used for cutting field shingles 803 to length, thereby hiding the shingle edge 804 from the elements, due to the shingle edge 804 being below the exterior gutter face 805.

Figure 9B:
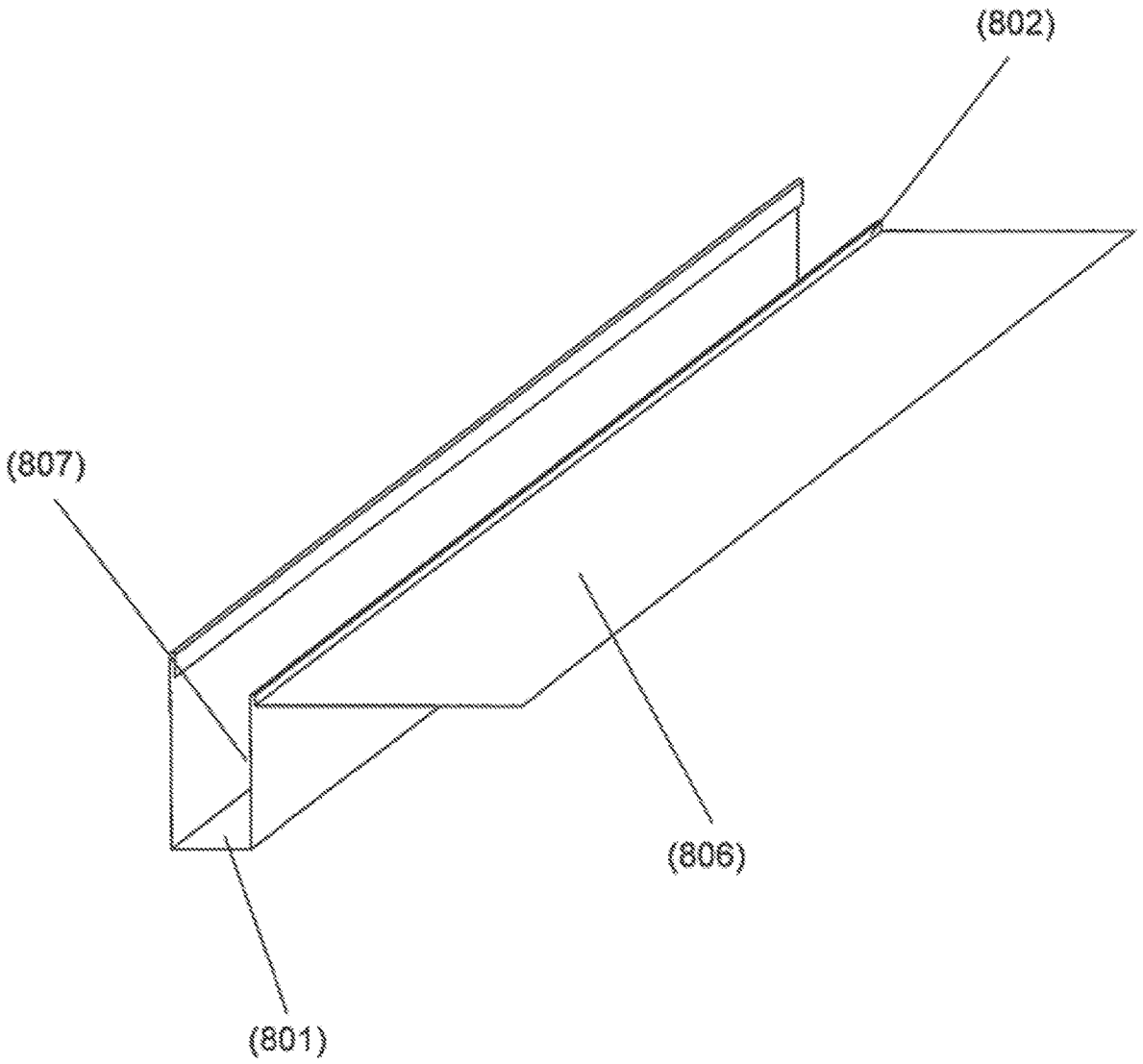
FIG. 9B is a front, upper, left side perspective view of a gutter with cutting guide, in accordance with embodiments of the present disclosure.

In the embodiment disclosed in FIG. 9B, the inside horizontal gutter cutting guide 806 is perpendicular to the nail flange 806 and becomes an extension of the inside gutter face 807. When the shingle is cut to size, it is configured to drop onto the nail flange 806.

Figure 10A:
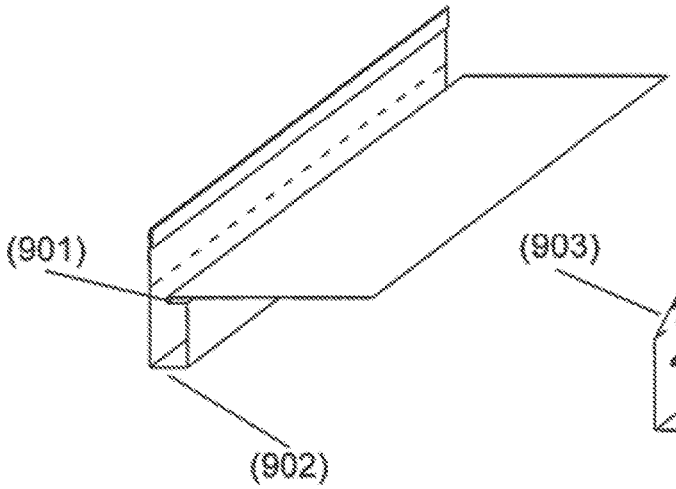
FIG. 10A is a front, upper, left side perspective view of a gutter with cutting guide and structurally-weakened elevated exterior plane, in accordance with embodiments of the present disclosure.

In still other embodiments, such as that shown in FIG. 10A, the rake edge gutter and cutting guide 901, are included within a D-style drip edge. This tucks the gutter further under the cutting guide 901 allowing a roofer to use a D-style drip edge at the eave location while obtaining the benefits of the present disclosure.

Figure 10B:
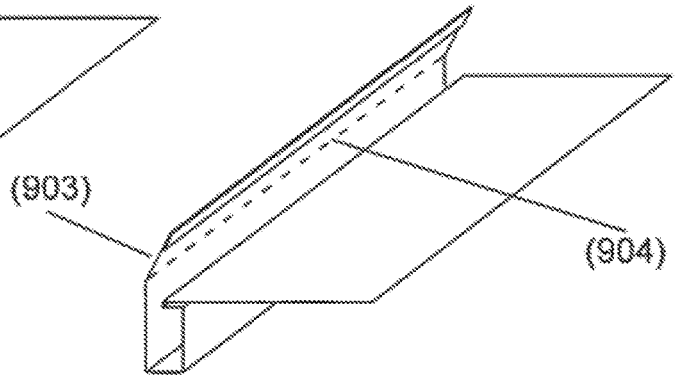
FIG. 10B is a front, upper, left side perspective view of the gutter with cutting guide and structurally-weakened elevated exterior plane of FIG. 10A, wherein the elevated exterior plane is partially folded, in accordance with embodiments of the present disclosure.
Figure 10C:
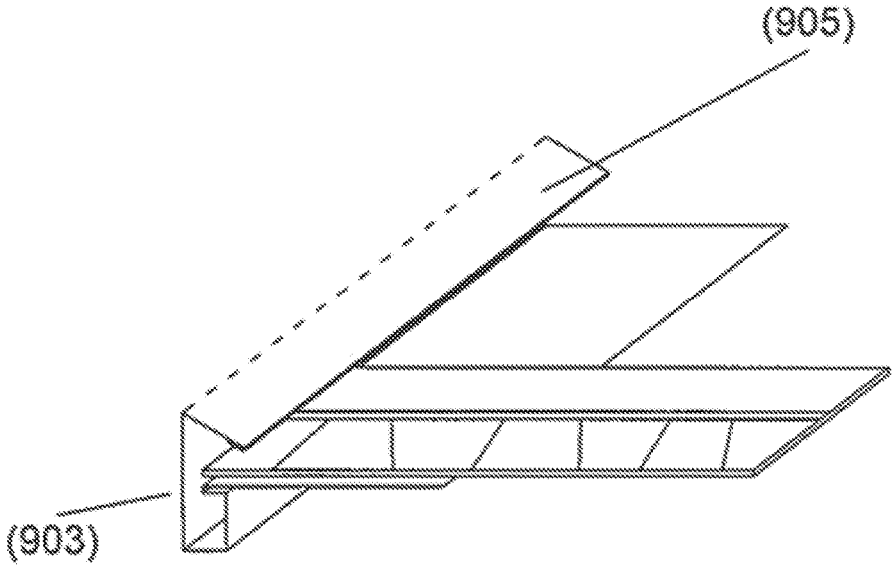
FIG. 10C is a front, upper, left side perspective view of the gutter with cutting guide and structurally-weakened elevated exterior plane of FIG. 10A, wherein the elevated exterior plane is fully folded, in accordance with embodiments of the present disclosure.

In FIG. 10B, a variation on this embodiment wherein the elevated exterior plane is structurally weakened 904 or slightly bent towards the roof plane for later folding onto the roofing shingles is disclosed. FIG. 10C discloses an even further variation on this embodiment wherein the folded exterior plane 905 is further imbedded into the shingles as high winds push against the elevated exterior plane 903 of the rake edge gutter. In addition, the irregular interface between the shingle surface and the folded exterior plane 905 maintains its ability to harvest water.

Figure 11A:
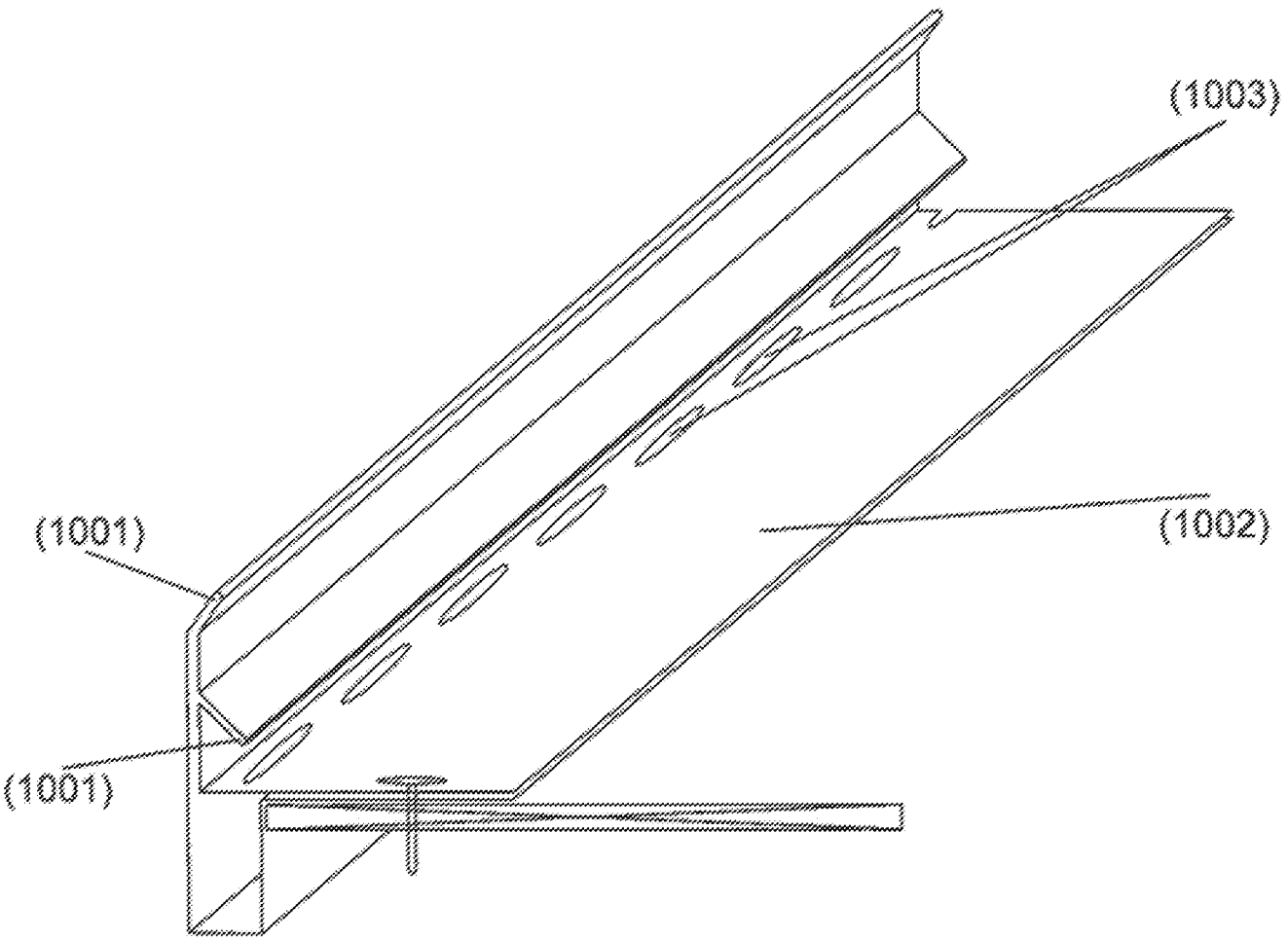
FIG. 11A is a front, upper, left side perspective view of a gutter with closed hem showing a nail driven through the nailing flange thereof, in accordance with embodiments of the present disclosure.
Figure 11B:
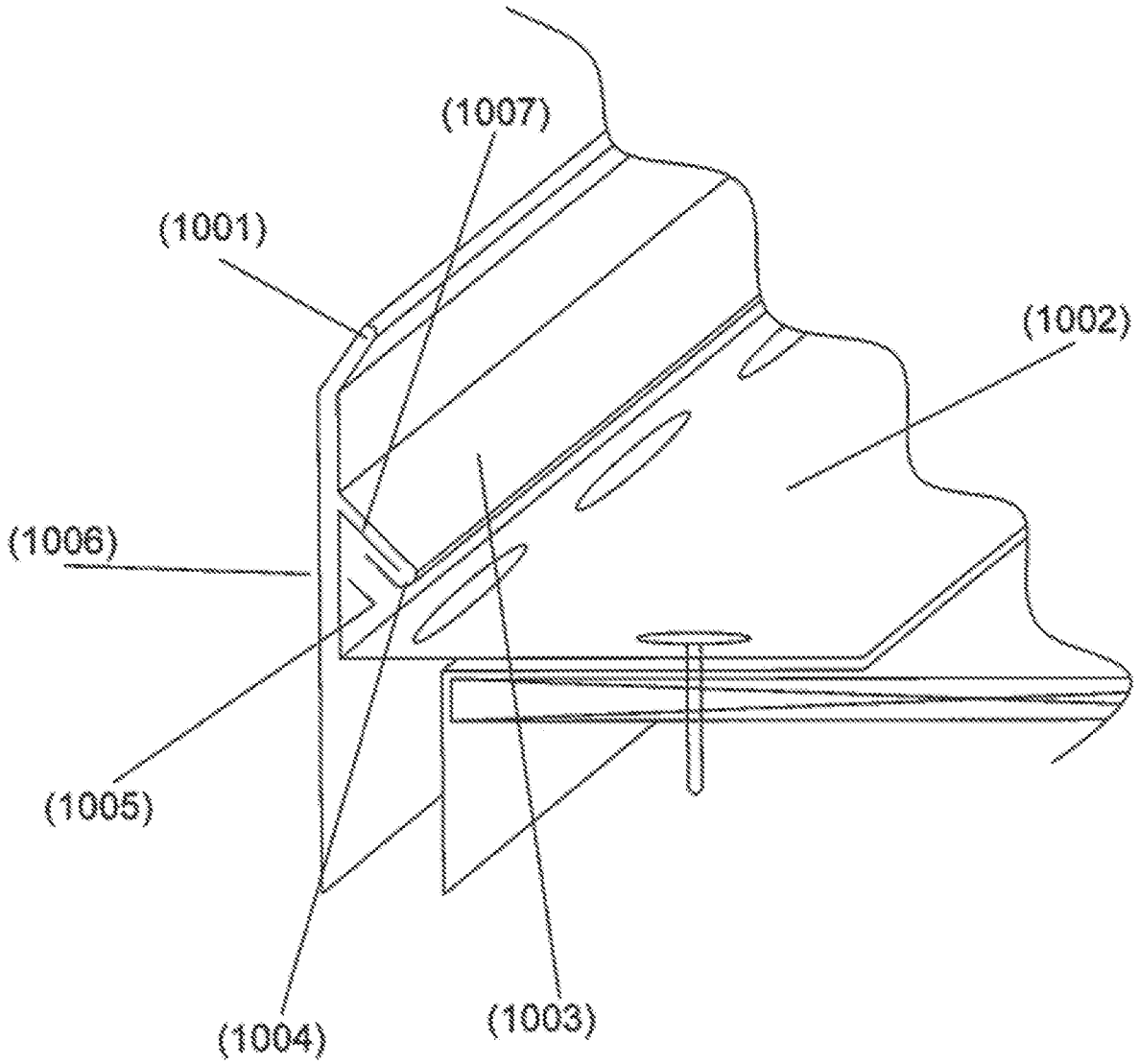
FIG. 11B is a close-up view of the gutter of FIG. 11A showing a downward angle extension thereof, in accordance with embodiments of the present disclosure.

Now referring to FIG. 11A, in embodiments, the rake edge gutter is fabricated from a relatively wide rough stock of metal, thereby creating numerous closed hems 1001, which result in an upper nail flange 1002 that gives the gutter rigidity. The upper nail flange 1002 with openings 1003 additionally permits for rake edge gutter water harvesting. The upper nail flange 1002 acts like a gutter cover and may be a separate section, as depicted in FIG. 11B. In embodiments, the upper nail flange 1002 is a separate second section of metal which is installed into the angled ledge 1003 and attaches to the lower hem 1004. The nail flange 1002 inside edge 1005 is essentially parallel to the outside gutter edge 1006 and terminates into a downward angled extension 1007 which fits into the lower hem 1004.

In embodiments, once the rake is completed and field shingles have been installed on top of the cutting edge, the roof mechanic will return back to the eave, elevate the second field shingle and cut the first field shingle to length. The roof mechanic will then elevate the third shingle and cut the second shingle to length, continuing in this fashion up the rake edge. Using this method, the roofer only cuts through a single shingle at a time, rather than multiple layers at once. As each single is cut to length, it drops onto the roof securement extension and is out of the way and not impacting the next shingle ready to be cut.

If the elevated exterior plane and cutting guide are fabricated to be above the roof plane, shingle fasteners may be kept back from the gutter, limiting the pressure on the shingle itself prior to being cut to length. When this situation arises, the roof mechanic will need to put additional fasteners into the field shingle closer to the edge of the rake edge gutter after pushing the shingles into and under the roof securement extension.

In embodiments, field shingles are cut to length by the roofer reaching under the shingle that is above the shingle being cut and drawing the knife down from ridge to eave. The cut should start at the head lap region of the shingle while the blade maintains contact with the groove or cutting guide; the installer may then draw a knife towards the weather exposed part of the field shingle, completing the cut.

Another benefit of embodiments of the present disclosure is that the gutter is not required to be pitched, due to the existing roof slope found on all rake edges. A typical fascia mounted gutter will have a slope of approximately ⅛ inch per foot. The normal roof pitch for a residential home is between 4/12 and 9/12. The average sloped roof in North America is 4/12. Anything below 4/12 or 18.43 degree pitch is low slope, and anything above is steep slope. If a roof has pitch less than 2/12 or 9.46 degree pitch, the roof is considered flat, and the gutter may be considered a fascia mounted versus rake mounted gutter.

Having a built in slope means that the rake edge gutter can maintain the same rake edge reveal throughout the installation. Embodiments of the rake gutter system disclosed herein are significantly smaller than current, fascia-mounted gutters. This is possible due to the lesser volume of water being mitigated, compared to fascia-mounted gutters, the rate of descent, and the smaller amount of water flowing over a rake edge, relative to the eave edge of a building.

Embodiments use flat sheet metal or flat sheet coil metal, in embodiments 26 gauge steel or 0.0320 inch aluminum. Nonferrous gauges (Aluminum) are not the same as ferrous gauges (Steel/Stainless). These gauges can vary based on field conditions and the properties desired for a given installation.

Figure 12:
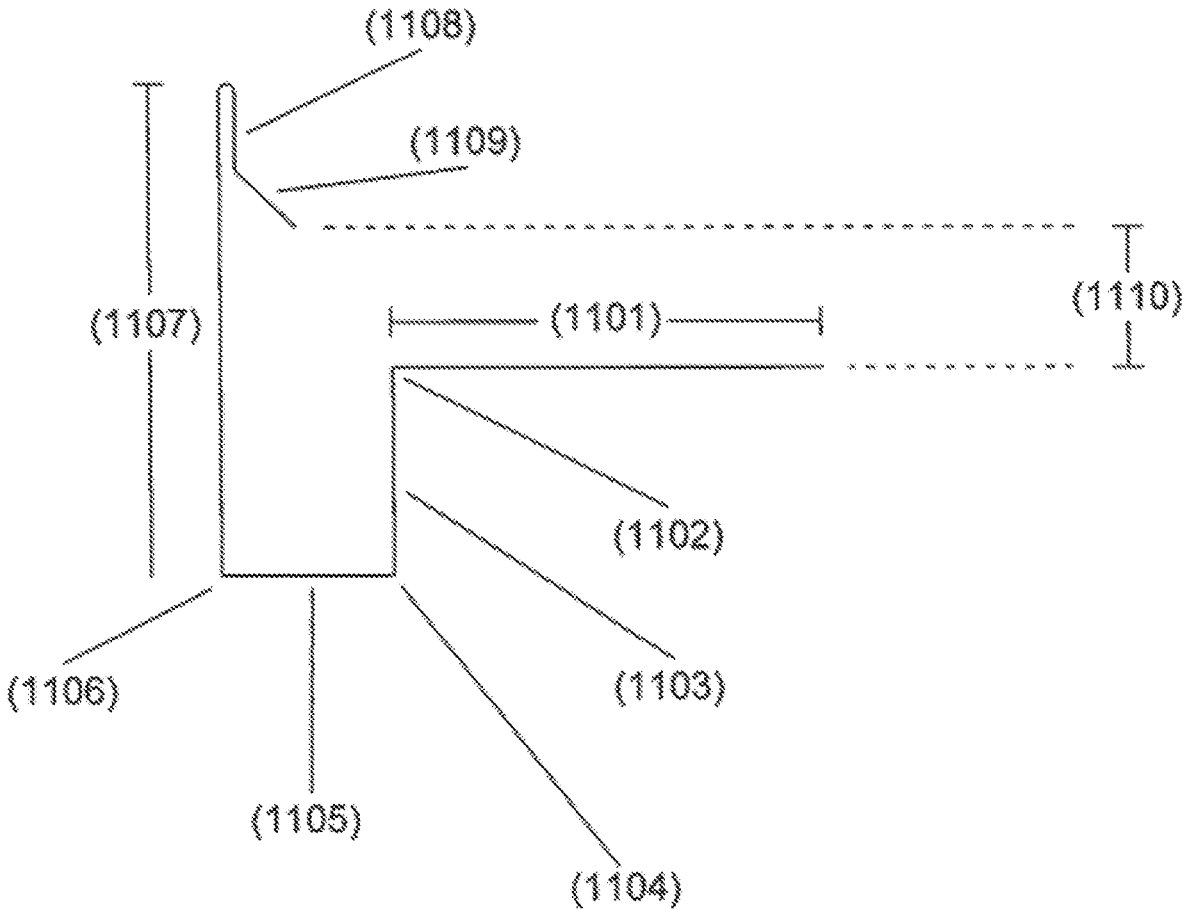
FIG. 12 is a left side elevation view of a drip edge gutter, in accordance with embodiments of the present disclosure.

Now referring to FIG. 12, an example of a rake edge gutter, metal, and fabrication requirements is disclosed and can be described as follows: the width of the rough stock from which one section is fabricated is 9.25". Working from the roof plane, a 2" nailing flange 1101, terminates into a 90 degree 1102 1½" inside gutter side 1103, a 90 degree 1104 1¼" gutter bottom 1105, a 90 degree 1106 approximately 3½" exterior plane 1107, which is approximate, due to the angle placed on the securement hem), a partially open ½" inside cutting hem 1108, which terminates into an approximate ½" downward angled shingle securement extension 1109 with the gap for shingle insertion 1110 being approximately 1". The downward angled securement extension 1109, in embodiments, has an additional attachment that may be used for securement purposes. In embodiments, the gutter itself has a width of only approximately 1¼", as defined by the gutter bottom 1105, as compared to eave mounted K-style gutters with openings of in the 5"-6" range.

Furthermore, when joining two drip edge sections, be it metal or plastic, at the peak of a roof, the roof mechanic may cut the rake drip edge to an approximate length and insert a peak termination piece. Such a piece provides for quick and concise installation and can accommodate some roof pitch variation. This may be preferable to cutting the device to a specific angle, due to its consistency and speed of application.

Embodiments further provide rake edge water harvesting retrofit solutions, aimed at owners who do not presently require roof replacement. In such embodiments, the nail flange is eliminated, so as not to interfere with the existing roofing system. Regarding the method of installation, in embodiments, an existing rake edge gutter may be left in place and, at a during a next roofing procedure, the shingle cutting guide may be used for shingle cutting.

Figure 13:
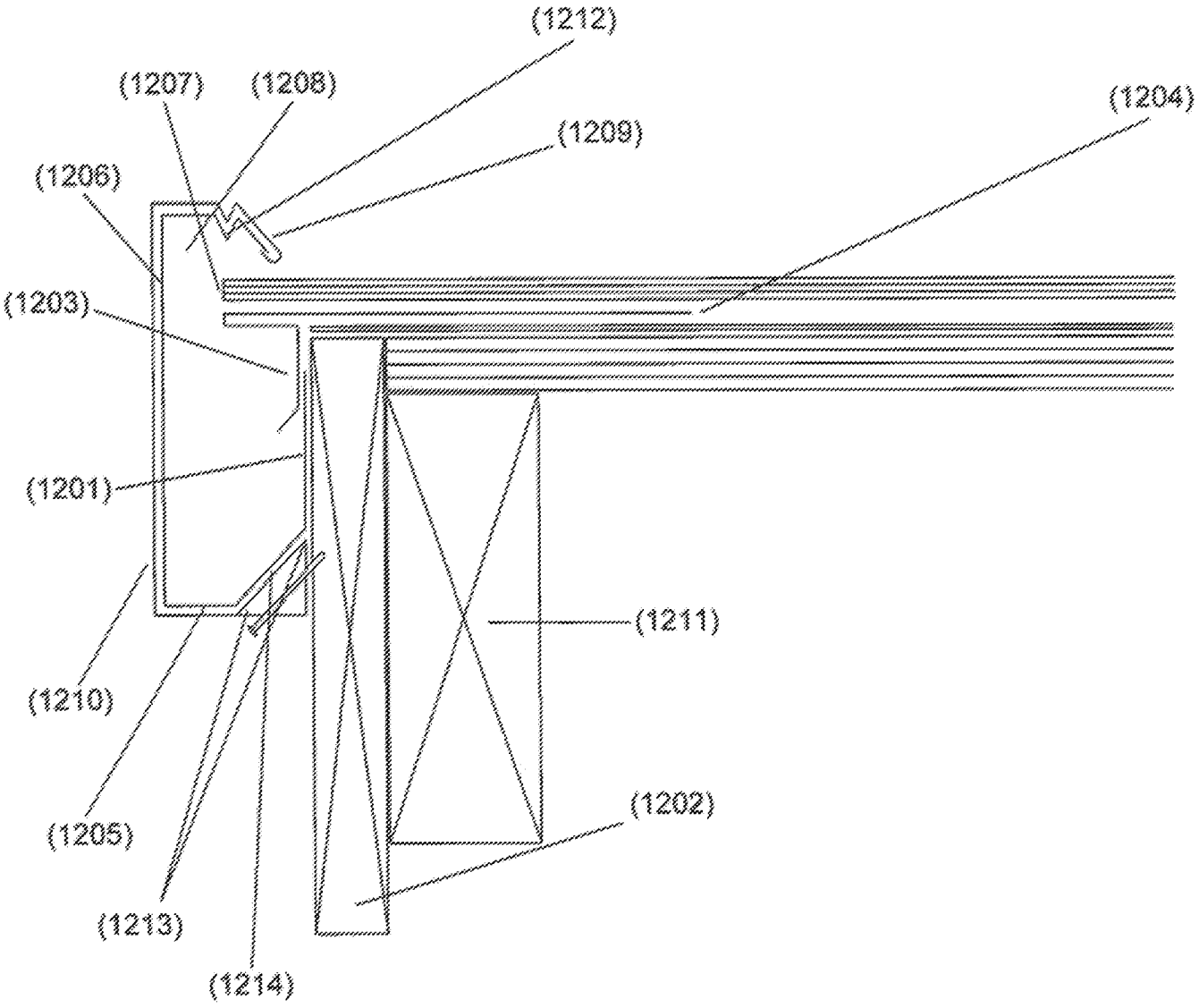
FIG. 13 is a left side elevation view of a drip edge gutter showing rake trim, brackets, and rake edge framing, for context, in accordance with embodiments of the present disclosure.

Now referring to FIG. 13, when installing a rake edge gutter without replacing the roof, the inside gutter edge 1201 is inserted into the interface of the rake trim 1202 and the drip edge face 1203. This is made possible due to the fact that the rake edge gutter does not need to be sloped to perform its function. This detail eliminates water getting behind the rake edge gutter and permits for removal of the existing drip edge 1204 at next roofing without impacting the rake edge gutter.

Furthermore, the gutter bottom 1205 and elevated exterior plane of embodiments creates an additional architectural feature to the rake edge while protecting the leading edge of the rake edge shingle from wind uplift. The elevated exterior plane 1206 is configured to terminate above the roof surface itself, thereby capturing water coming off the rake edge during rain and wind events. This feature also adds protection from winds hitting the exposed face 1207 of already installed rake edge shingles, which may not have benefitted from new code requirements for shingle uplift mitigation.

To maintain the functionality of the opening 1208 between the downward angled extension 1209 and the inside gutter edge 1201, embodiments utilize brackets 1210 installed on the outside of the rake edge gutter. In some rare instances, such as metal roof installations, where the cutting guide may not assist in cutting metal roofing inside hangers, direct roof attachment or gutter spikes may be used.

In embodiments, maintaining the opening 1208 requires an outside bracket 1210, which is attached through the rake trim 1202 into the rake edge framing 1211. As the framing 1211 on rake edges tends to be a continuous framing 1211 member, the placement of brackets is not contingent on finding rafter tails.

This continuous framing 1211 member additionally allows the installer to place brackets 1210 at a rate that suits the weather conditions for a given region. In embodiments, the brackets 1210 hook around the downward extension 1209, which may be an open or closed hem, and follow the contour of the groove 1212 or elevated nodule, wrap around the outer face of the elevated exterior plane 1206, and abut the gutter bottom 1205, transitioning into approximately a 45 degree angle 1213, creating a gutter bracket abutment 2014 that terminates into the inside gutter edge 1201.

Figure 14:
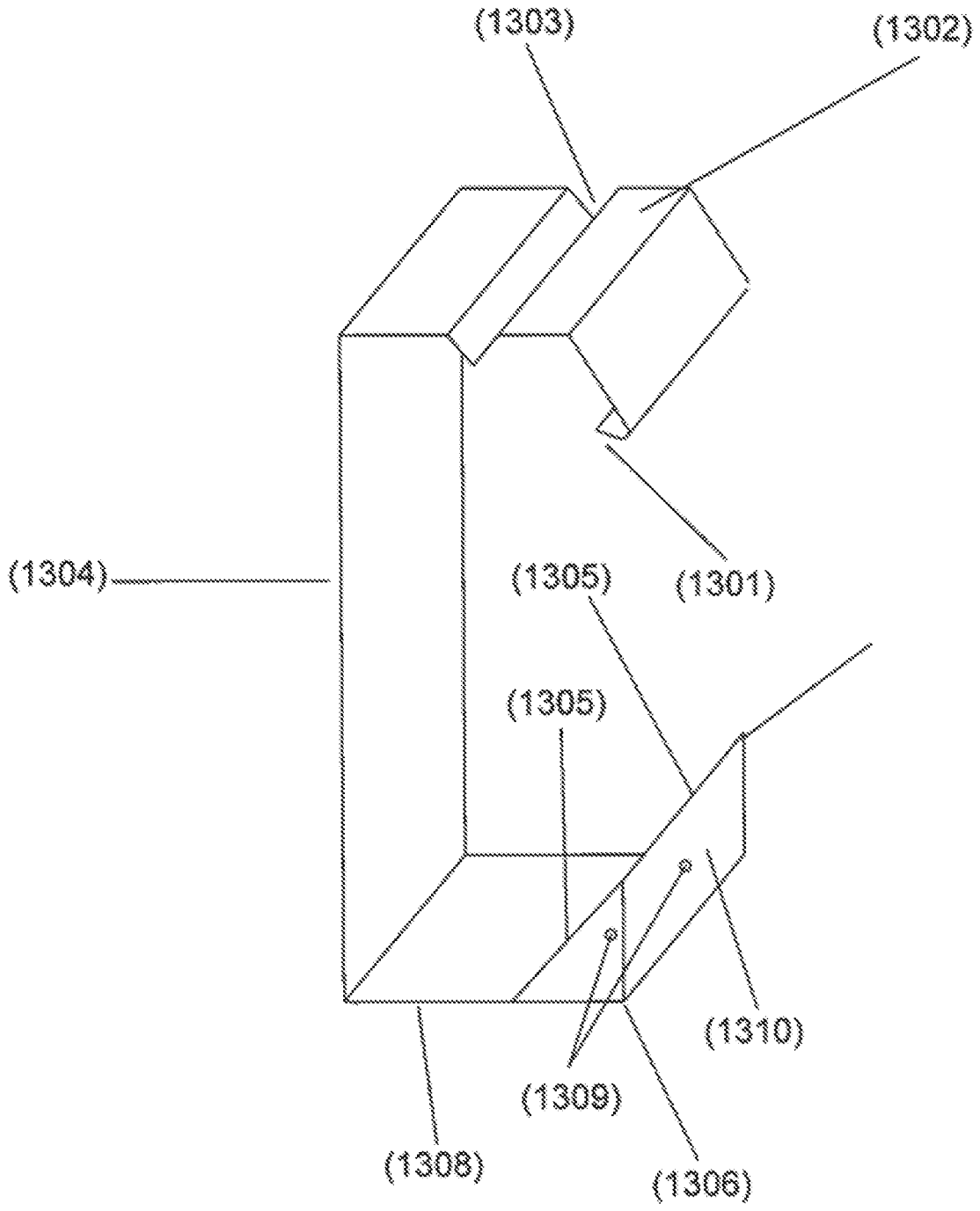
FIG. 14 is a front, upper, left side perspective view of a bracket, configured in accordance with embodiments of the present disclosure.

Now referring to FIG. 14, a mounting bracket of FIG. 13 is shown in more detail. In embodiments, the open hem 1301 of the bracket hooks the downward angled extension of the rake edge gutter. The bracket then follows the profile of the top edge 1302 of the gutter, including the groove 1303 used to cut shingles to length. The face 1304 of the bracket can have a number of profiles that complement bracket strength and the aesthetics of the piece. Once the bracket reaches the gutter bracket abutment 1305, it continues to the rake trim and runs parallel with the gutter bottom, past the 45 degree angle of the gutter, to the rake trim, at 90 degrees 1306 and parallel to the rake trim before being folded again at approximately 45 degrees 1307 to mirror the angle of the gutter underside. The bracket then terminates at the bracket bottom 1308. In embodiments, the bracket is further predrilled 1309 through the bracket bottom 1308 and through the trim abutment 1310. The predrilled 1309 hole through the bracket bottom 1308 may be counter sunk or indented in such a fashion as to hide the screw head within the bracket itself. Furthermore, the screw may be inserted at the point of manufacturing or in the field at the time of rake edge gutter installation.

In embodiments, when looking at the rake edge from a distance the elevated exterior plane of the rake edge gutter is configured to hide the underside of the brackets and related fasteners. Furthermore, the rake edge gutter delivers moisture into the eave mounted gutter, which thereby hides the visual effect of the brackets when looking at the front of the structure.

In embodiments, these rake edge gutter sections are provided in single lengths or roll-formed on-site. Roll forming on site lets the installer fabricate the rake edge gutter to length, thereby eliminating unsightly joints in and speeding up the installation. Furthermore, with joints being eliminated, the roofer can take advantage of a seamless approach to the shingle cutting guide at next roofing.

In embodiments, at the peak of the roof, a small piece of matching metal completes the angle at which the two rake edge gutters intersect. This piece may be riveted into place without the use of hangers or brackets.

When developing our rake edge gutter we considered the architect. An architect when designing a roof will consider the materials used and how the pitch of the roof affects the way the building will look. When working with the owner the architect will also consider the Golden Ratio. Simply put, the Golden Ratio provides a sense of equilibrium and balances out the building and, in our case, the products developed. In an embodiment, when seen from the ground, such embodiment has a 1¼" gutter bottom along with a 3" elevated exterior plane. This gets close to the Golden Ratio and adds an architectural detail to an otherwise flat or irregular looking rake edge.

It is also common for fascia mounted gutters to have the eave tube, which is connected to the downpipe, to be located where the building becomes a gable end. This is also the typical location for the rake edge of the building. As such, when water is funneled through the rake gutter system it will most likely result in being delivered fairly close to the downpipe of the fascia mounted gutter. Because of this, rake edge water will not need to travel very far along the eave gutter system. Insects and debris can become a concern with gutters but, given the aggressive slope of our rake gutter device, such items are quickly flushed out.

Due to the features and construction of embodiments, the harvesting of rake edge water now becomes practical. On many homes built well into the 1990's the rake edge exterior trim was extended past the fascia, thereby providing for a pocket or inset into which the end of the gutter can abut. Many of these extensions are prone to rot and decay both from water being trapped at the interface of the rake trim and the end of the gutter, as well as from direct water impacting the top of the rake trim extension.

During remodeling, many of these exterior rake trims are eliminated and the gutter is run past the rake edge of the roof. In new construction today the rake trim extension is often eliminated altogether and the gutter is installed past the end of the rake edge. The preferred method of harvesting water into the eave mounted gutter is to have the gutter extend past the rake gutter itself. This now permits for the rake edge gutter to deliver moisture directly into the fascia mounted gutter without the use of downpipes and related sundries.

Embodiments of the present disclosure permit for harvesting water during inclement weather, when the wind is often blowing moisture across the roof plane. More specifically, disclosed herein is an "active" approach to gathering water; the elevated exterior cutting edge and the downward locking hem are configured to direct water into the rake gutter. The rake gutter can now redirect water that used to flow off the gable end into existing fascia mounted gutter systems and eventually dispense with it or feed a water-harvesting apparatus.

Furthermore, high winds are known to cause roof damage, depending on their strength. Typically, heavy rains are caused by pressure fronts, while lighter rains are caused by the convective process. High-speed winds often accompany heavy rains, especially if accompanied by a tropical front. These strong winds historically blow a substantial amount of water off of the gable end of a structure and make its collection improbable. Embodiments of the present disclosure provide for harvesting of this water.

In the United States, approximately 100,000 thunderstorms occur each year, the amount of water which can be harvested off a rake edge varies depending on wind speeds, temperature, humidity, topography and the storm itself. A storm is considered severe when wind speeds exceed 58 miles/hr. with rainfall loss off of the rake increasing as wind speed increases.

State wide averages of annual rainfall plus snow fall range from a high of 63.7 inches (1618 millimeters) in Hawaii to a low of 9.5 inches (241 millimeters) in Nevada. For the continental United States, i.e. excluding Hawaii and Alaska, the average amount of moisture falling as rain and snow is 30.21 inches (767 millimeters). The precipitation averages are based on data collected by weather stations throughout each state and provided by NOAA National Climate Center.

Additionally, when determining the amount of water that can be captured from a rake edge gutter, the slope becomes a factor. The longer water stays on a roof, the greater the likelihood it will be impacted by wind, which tends to drive moisture off of the gable end of the structure. We will return to this factor later in our discussion, however it is typical to not factor for slope but only the footprint of the building when calculating water harvesting of a structure captured by an eave mounted gutter for a given region. As such, the average home in the United States is 2,100 square feet and receives an average amount of moisture of 30.21 inches. On such a home, every inch of rainfall equates to 1,260 gallons of water captured per one inch of water. That equates to approximately 38,000 gallons of water captured annually. Granted, in some regions, the moisture partially falls as snow, but the number remains substantial. Now, factoring for the length of time water remains on a 4/12 pitch roof, while a breeze of 19-24 miles per hour is blowing across the roof plane, approximately 10-12% of water impacting the roof is lost off the gable end of a home.

During such weather events, starter shingles provide for field shingle adhesion at the rake edge, as disclosed by Hudson in U.S. Pat. No. 6,199,338. Prior to Hudson, starter shingles were made by cutting the top off field shingles. Our disclosure does not require starter shingles to secure the field shingle to the roof, due to the elevated gutter edge protecting the leading edge of shingles form the effects of wind. Starter shingles also provide for a clean edge when looking at the rake by providing for a consistent shingle overhang. Once again, embodiments of the rake edge gutter disclosed herein provide for a clean exposed metal edge, eliminating the need for a starter shingle.

Embodiments of the present disclosure further eliminate the unsightly rake edge, which can result from cutting cold shingles or due to non-weather related factors. An irregular or jagged appearing edge is often created when cutting field shingles that have already been installed. A roof mechanic sitting on the roof surface will have the tendency to pull the cutting edge towards oneself rather than off the rake edge. As such, the field cut shingle may have a slight angle towards the field of the roof, therefore water flowing along or being driven into the rake edge will be driven towards the interface of the field shingle and the starter shingle, which may cause water infiltration.

When installing a starter shingle the better roofer will install the shingle using the edge of their finger as a guide for shingle overhang. The required overhang will have been achieved without any lines or measuring devices. The typical starter shingle overhang is ⅜" and a good roofer uses the feel method when installing each starter shingle section and by doing so compensates for any eave to ridge variables. This step is now required when using our rake edge gutter.

A starter shingle installed up the rake also slightly elevates the plane of the roof, diverting water back towards the field of the roof. This works well when the rake trim is installed on the same plane as the substrate, although this does not always happen and sometimes the rake trim package is installed below the substrate, causing water to run off the gable end, even with the benefit of a starter shingle. Embodiments of the present disclosure harvest any water flowing off the rake edge, regardless of the how the trim package was installed; by eliminating the starter shingle additional water may be captured by the rake gutter.

Typically, each rake edge section will be manufactured to a 10 foot length. Each end of the section will need to be modified, fitting one piece into the other, with the upper section fitting into the lower section. This fitting strengthens the structure and provides for positive water flow off of the rake edge. When notching a section of rake edge gutter, the upper section of embodiments fits into the lower section. These areas of notching or metal compression depend on the profile of the rake edge gutter. In embodiments, the rake edge gutter is roll-formed in the field and fabricated to the desired length, without requiring notching or other joining methods.

If joining of sections is required, the upper section of embodiments is pushed into the lower section; the end of the inside of the cutting guide and the end of the downward shingle extension of each section abutting one another. The end of the elevated exterior plane of the upper section is then inserted into the interface of the lower section. The notch may also be angled, providing for one section of the gutter to sit within the gutter section of the next piece. Once again, each section may interconnect with the next section using a notching detail specific to the profile of the given piece. During the fabrication process, it is also well known to expand and or compress ends of metal, so as to fit one section into the next with a limited amount of notching being required, depending on the profile being fabricated.

When facing the front or the back of the building, there will be a left side and a right side. The difficulty is that the right side sections will not interconnect from the same end as the left side sections or vice versa. In embodiments, the installation begins at the eave working its way towards the peak with each subsequent section being placed into the earlier section installed. This provides water flow from the upper sections into the lower section. In either case, the nailing flange, when installed on one rake, faces the nailing flange on the other rake. Where the one combining ability end is directed towards the eave, it now becomes directed toward the peak when installed on the opposite rake edge. This inversion means that the end of the section which gets crimped, notched or reduced varies from left to right or vice versa.

Furthermore, while a rake edge gutter will not have standing water, it does not have eave tubes, rivets, screws, gutter seal or downpipes which can create an elevated plane within the gutter, which could cause a block or otherwise impede the movement of water. Typically, a rake gutter will only be put into use, and be called on to perform, at least in any substantial way, during inclement weather. Therefore, the upper section being placed into the lower section is optional, in embodiments.

Although we have designed this disclosure to be specific to asphalt shingle applications, variations of the disclosed embodiments may also be applicable to metal, metal shingles, wood shingles, wood shakes, slate and masonry tiles.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

What is claimed is:

1. A drip edge, the drip edge comprising:

a nail flange; and a gutter extending from said nail flange, wherein said gutter is configured to extend below a rake edge of a roof when the nail flange is fixed to a portion of a roof substrate adjacent the rake edge, a top section connected to an outermost, top edge of the gutter and extending towards said nail flange, the top section comprising a cutting guide configured to allow an installer to run a cutting device along to cut roofing shingles to a predetermined length and a extension extending from the cutting guide toward the nail flange on the side of the cutting guide closest the nail flange;

wherein at least a portion of said nail flange is planar, wherein at least a portion of said top section is planar, wherein said planar portion of said top section is parallel to said planar portion of said nail flange, wherein said cutting guide comprises a groove, wherein said extension is configured to cover a portion of a shingle cut using the cutting guide and extending off of the edge of the roof and thereby help secure the shingle to the roof on which the drip edge is installed, and wherein said drip edge is configured to be installed parallel and adjacent to a rake edge.

2. The drip edge of claim 1 wherein said gutter and drip edge are a single, unitary piece of sheet metal.

3. The drip edge of claim 1 wherein said shingle-securing section comprises a top portion of said gutter configured to be folded over onto said shingle, following the installation thereof, thereby securing the shingle against wind uplift while simultaneously hiding the cut edge thereof.

4. The drip edge of claim 3 wherein an interface between said gutter and said extension is pre-weakened, thereby allowing the extension to be more easily bent over a shingle.

5. The drip edge of claim 1 wherein a drip edge-facing portion of said gutter is oriented perpendicularly to said upper face of said drip edge and further comprises a downward-facing protrusion configured to cover a shingle abutting said drip edge-facing portion of said gutter.

6. The drip edge of claim 5 further comprising an upward-facing protrusion that is also angled towards the nail flange, wherein said upward-facing protrusion is configured to add rigidity to said drip edge while forcing said downward-facing protrusion configured to cover a shingle abutting said flashing-facing portion of said gutter into forceful contact with a shingle positioned between the upper face of said flashing and said downward-facing protrusion during across-the-roof wind events wherein the wind is incident on an outside edge of said drip edge.

7. The drip edge of claim 5 wherein an uppermost-portion of said drip edge-facing portion of said gutter comprises a double hem.

8. The drip edge of claim 1 wherein said nail flange comprises a plurality of apertures sized to accept nails therethrough and to mark desired nailing locations.

9. The drip edge of claim 8 wherein said apertures are oval in shape.

10. The drip edge of claim 8 wherein said apertures are square in shape.

11. The drip edge of claim 8 wherein said apertures are circular in shape.

12. The drip edge of claim 8 wherein said apertures are rectangular in shape.

13. The drip edge of claim 1 wherein said flashing, on a lowest point of an outward-facing face thereof, further comprises a kick configured to angle outwardly from a roof following installation of the drip edge thereon.

14. The drip edge of claim 1 wherein said nail flange comprises markings describing the desired location of field shingle termination points thereon.

15. The drip edge of claim 1 wherein said drip edge is configured to deliver moisture into a fascia mounted gutter without the use of downpipes.

16. The drip edge of claim 1 wherein an outer edge of said gutter is elevated above the nail flange.

17. The drip edge of claim 1 wherein said drip edge is made of a material selected from the group consisting of flat sheet coil metal, flat sheet metal, and plastic.

18. A rake edge gutter, the rake edge gutter comprising:

a top edge, a rake edge gutter bottom opposite the top edge, an elevated exterior plane, an inside gutter edge opposite the elevated exterior plane, and a nail flange extending from the inside gutter edge; and a cutting guide disposed in an upper surface of said top edge, the cutting guide being configured to allow an installer to run a cutting device along to cut roofing shingles to an-predetermined length, wherein at least a portion of the nail flange is planar, wherein the inside gutter edge is configured to be positioned behind, and terminate below, a rake edge, abutting against a building envelope, following installation of the rake edge gutter on a rake edge, wherein the elevated exterior plane is substantially taller than said inside gutter edge and is configured to extend above a rake edge following installation of the rake edge gutter on a rake edge, wherein said rake edge gutter bottom connects said inside gutter edge to said elevated exterior plane and is configured to extend past a rake edge following installation of the rake edge gutter on a rake edge, wherein said top edge further comprises a proximal portion fixed to said elevated exterior plane and a distal end positioned closest to said inside gutter edge of said rake edge gutter, wherein the distal end of said top edge further comprises a shingle securing feature in the form of an extension, said extension configured to hide the edge of a shingle cut using said cutting guide and act as a barrier against cross-winds that could cause shingle uplift, wherein at least a portion of said top edge is planar and parallel to said planar portion of said nail flange, and wherein said cutting guide comprises a groove located in a portion of the rake edge gutter that is outside of a roof following installation of the rake edge gutter thereon.

19. The rake edge gutter of claim 18 wherein said gutter is predrilled for fasteners.

20. The drip edge of claim 1 wherein the cutting device is a hook blade.

* * * * *